US010050332B2

(12) United States Patent
Kim et al.

(10) Patent No.: US 10,050,332 B2
(45) Date of Patent: Aug. 14, 2018

(54) ANTENNA DEVICE AND ELECTRONIC DEVICE INCLUDING THE SAME

(71) Applicant: Samsung Electronics Co., Ltd, Gyeonggi-do (KR)

(72) Inventors: Min-Seok Kim, Seoul (KR); Hyuncheol Jin, Gyeonggi-do (KR); Sung-Won Park, Gyeonggi-do (KR); Sungchul Park, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/237,608

(22) Filed: Aug. 15, 2016

(65) Prior Publication Data

US 2017/0047641 A1 Feb. 16, 2017

(30) Foreign Application Priority Data

Aug. 13, 2015 (KR) ..... 10-2015-0114252

(51) Int. Cl.

| | |
|---|---|
| ***H01Q 1/24*** | (2006.01) |
| ***H01Q 1/50*** | (2006.01) |
| ***H01Q 13/10*** | (2006.01) |
| ***H01Q 5/364*** | (2015.01) |
| *H01Q 9/04* | (2006.01) |

(52) U.S. Cl.

CPC ..... *H01Q 1/243* (2013.01); *H01Q 1/50* (2013.01); *H01Q 5/364* (2015.01); *H01Q 13/103* (2013.01); *H01Q 1/245* (2013.01); *H01Q 9/0421* (2013.01)

(58) Field of Classification Search

CPC ..... H01Q 1/243; H01Q 1/50; H01Q 13/103; H01Q 1/245; H01Q 1/48; H01Q 1/521; H01Q 5/364; H01Q 9/0421

See application file for complete search history.

(56) References Cited

U.S. PATENT DOCUMENTS

2011/0012794 A1* 1/2011 Schlub ..... H01Q 1/243 343/702
2011/0050508 A1* 3/2011 Guterman ..... H01Q 1/2266 343/702
2013/0321216 A1* 12/2013 Jervis ..... G06F 1/1616 343/702
2014/0240190 A1* 8/2014 Chen ..... H01Q 5/30 343/843
2014/0266922 A1* 9/2014 Jin ..... H01Q 21/28 343/702

(Continued)

*Primary Examiner* — Tho G Phan

(57) ABSTRACT

According to various embodiments, there is provided an electronic device including: a housing; a first conductive member that forms a portion of the housing and is at least partially disposed within the housing; a second conductive member that forms another portion of the housing and includes a portion disposed adjacent to a portion of the first conductive member; a non-conductive member disposed between the portion of the first conductive member and a portion of the second conductive member; a capacitive coupling structure coupled between the first conductive member and the second conductive member; a communication circuit electrically coupled to the first conductive member; and a sensor electrically coupled to the first conductive member. Various other embodiments may be made.

19 Claims, 11 Drawing Sheets

(56) References Cited

U.S. PATENT DOCUMENTS

| | | | | |
|---|---|---|---|---|
| 2014/0292587 | A1* | 10/2014 | Yarga | H01Q 1/243 343/702 |
| 2014/0361979 | A1 | 12/2014 | Woo et al. | |
| 2014/0375510 | A1* | 12/2014 | Lee | H01Q 1/243 343/702 |

* cited by examiner

ANTENNA DEVICE AND ELECTRONIC DEVICE INCLUDING THE SAME

CROSS-REFERENCE TO RELATED APPLICATION(S) AND CLAIM OF PRIORITY

The present application is related to and claims the priority under 35 U.S.C. § 119(a) to Korean Application Serial No. 10-2015-0114252, which was filed in the Korean Intellectual Property Office on Aug. 13, 2015, the entire content of which is hereby incorporated by reference.

TECHNICAL FIELD

Various embodiments of the present disclosure relate to an electronic device. For example, various embodiments of the present disclosure relate to an electronic device that includes an antenna device.

BACKGROUND

As functional differences have been considerably reduced among electronic devices, each manufacturer has been making efforts to increase the rigidity of electronic devices, to strengthen a design aspect of the electronic devices, and to slim the electronic devices. As one aspect of such a trend, efforts have been made to efficiently secure a space for disposing at least one antenna device that shall be essentially provided for communication among a plurality of components of the electronic devices, and at the same time, to prevent degradation of the radiating performance of antenna devices in advance and to make the antenna devices exhibit excellent performance.

Antenna devices used in an electronic device have an inverted-F antenna (IFA) or a monopole radiator as a basic structure, and a volume and number of mounted antenna radiators may be determined based on frequency, bandwidth, and a kind of each service. For example, although there is a difference in frequency from region to region in the world, typically a low band of 700 megahertz (MHz) to 900 MHz, a mid band of 1,700 MHz to 2,100 MHz, and a high band of 2,300 MHz to 2,700 MHz are used as main communication bands. In addition, wireless communication services (e.g., bluetooth (BT), global positioning system (GPS), and wireless fidelity (WIFI)) are used. While a plurality of antennas is required in order to support the aforementioned communication bands, a communication device may have a restrictive antenna volume space. In order to overcome this problem, service bands, which are similar to each other in terms of frequency bands, are lumped with each other and are designed to be split to several antennas.

For example, an antenna that is in charge of voice/data communication (e.g., general packet radio service (GPRS), wideband code division multiple access (WCDMA), or long-term evolution (LTE)), which is a major communication protocol of a terminal, may be positioned in a lower end of an electronic device where few metallic components to inhibit antenna performance exist. By European standards, 24 bands in total may be implemented including 2G (global system for mobile communication (GSM)850, evolved GSM (EGSM), digital communication system (DCS), personal communication system (PCS)), WCDMA (B1, B2, B5, B8), and LTE (B1, B2, B3, B4, B5, B7, B8, B12, B17, B18, B19, B20, B26, B38, B39, B40, B41). In fact, it is difficult to meet service providers' specifications and specific absorption rate (SAR) standards and to minimize effects on the human body while implementing all the bands in one antenna. Thus, service bands, of which the frequency bands are similar to each other over at least two regions, may be lumped with each other so as to implement an antenna. As an example, 2G (GSM850, EGSM, DCS, PCS), WCDMA (B1, B2, B5, B8) and LTE (B1, B2, B3, B4, B5, B8, B12, B17, B18, B19, B20, B26, B39) may be implemented in one antenna, and an antenna for LTE (B7, B38, B40, B41) may be designed in another antenna.

In addition, in the case where the exterior of an electronic device is constituted with a metal member (e.g., a metal bezel) according to the recent trend, an antenna that is designed using the metal member is used as an antenna radiator rather than separately designing the antenna, unlike an injection molded product of a dielectric material.

For example, in the case where a metal bezel used in the rim of an electronic device is utilized as an antenna radiator, a specific area of the metal bezel may be severed by split portions made of a dielectric material and an electric distance of the antenna from a power feeding unit such that the antenna radiator can be implemented to operate in a desired frequency band.

Recently, in many cases, at least two metal members, which are severed by split portions, are electrically connected and used. In such cases, power feeding is performed in one metal member at one side with reference to a split portion, and the remaining one radiator may be applied as a parasitic radiator in order to expand the bandwidth of the antenna device or to change the operating frequency band of the antenna device. According to one embodiment, in such a case, two metal members, which are split by a split portion, are electrically connected and used.

However, in such a case, one metal member, which is fed with power, may also be used not only as an antenna radiator, but also as a sensing member by a sensor module, and it may be necessary for the two metal members to have a split structure in order to optimize a leakage current generated in neighboring metal members. In addition, it may also be necessary for the two metal members to have a mutual electric connection structure in order to optimize the radiation performance of the antenna radiator. At present, two electrically connected metal members may contribute to the improvement of the antenna performance of an antenna device, but may cause a performance degradation of the electronic device.

SUMMARY

To address the above-discussed deficiencies, it is a primary object to provide an antenna device and an electronic device including the antenna device.

According to various embodiments, it is possible to provide an antenna device and an electronic device including the antenna device which is capable of contributing to the improvement of a sensing function and the optimization of a leakage current, as well as contributing to the improvement of an antenna radiation performance.

According to various embodiments, it is possible to provide an electronic device that includes: a housing; a first conductive member that forms a portion of the housing and is at least partially disposed within the housing; a second conductive member that forms another portion of the housing and includes a portion disposed adjacent to a portion of the first conductive member; a non-conductive member disposed between the portion of the first conductive member and a portion of the second conductive member; a capacitive coupling structure connected between the first conductive member and the second conductive member; a communication circuit electrically connected to the first conductive member; and a sensor electrically connected to the first conductive member.

Before undertaking the DETAILED DESCRIPTION below, it may be advantageous to set forth definitions of certain words and phrases used throughout this patent document: the terms "include" and "comprise," as well as derivatives thereof mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
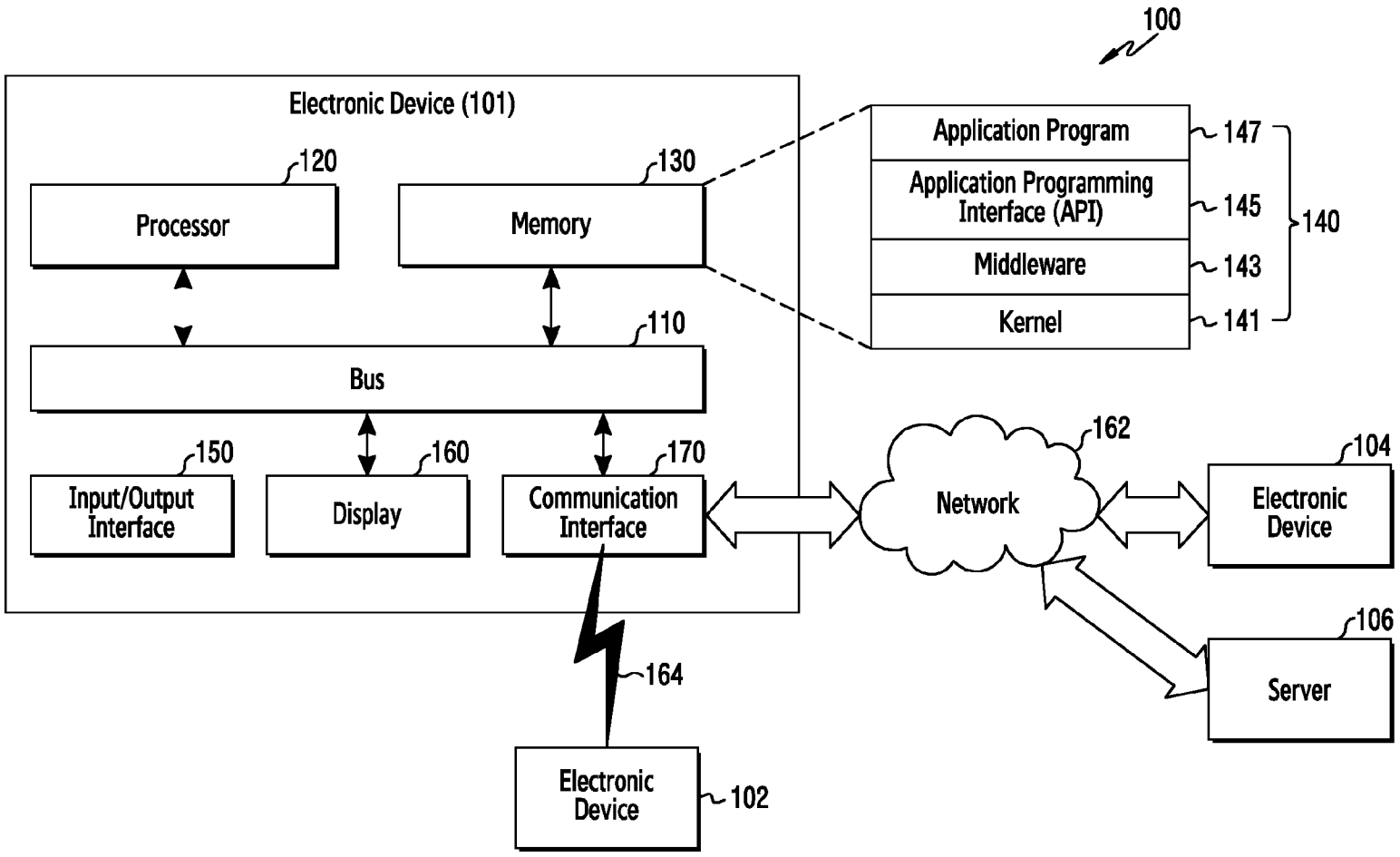
FIG. 1 illustrates a view of a network environment that includes an electronic device according to various embodiments of the present disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device. The following description with reference to the accompanying drawings is provided to assist in a comprehensive understanding of certain embodiments of the present disclosure as defined by the claims and their equivalents. It includes specific details to assist in that understanding but these are to be regarded merely as examples. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to their dictionary meanings, but, are merely used to enable a clear and consistent understanding of the present disclosure. Accordingly, it should be apparent to those skilled in the art that the following description of various embodiments of the present disclosure is provided for illustrative purposes only and not for the purpose of limiting the present disclosure as defined by the appended claims and their equivalents.

It is to be understood that the singular forms "a," "an," and "the" include plural references unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The terms "include" and "may include" used herein are intended to indicate the presence of a corresponding function, operation, or constitutional element disclosed herein, and are not intended to limit the presence of one or more functions, operations, or constitutional elements. In addition, the terms "include" and "have" are intended to indicate that characteristics, numbers, operations, constitutional elements, and elements disclosed in the specification or combinations thereof exist. However, additional possibilities of one or more other characteristics, numbers, operations, constitutional elements, elements or combinations thereof may exist.

As used herein, the expression "or" includes any and all combinations of words enumerated together. For example, "A or B" may include either A or B, or may include both A and B.

Although expressions used in various embodiments of the present disclosure, such as "1 st", "2nd", "first", "second" may be used to express various constituent elements of the various embodiments of the present disclosure, these expressions are not intended to limit the corresponding constituent elements. For example, the above expressions are not intended to limit an order or an importance of the corresponding constituent elements. The above expressions may be used to distinguish one constituent element from another constituent element. For example, a first user device and the second user device are both user devices, and indicate different user devices. For example, a first constituent element may be referred to as a second constituent element, and similarly, the second constituent element may be referred to as the first constituent element without departing from the scope of the present disclosure.

When an element is mentioned as being "connected" to or "accessing" another element, this may mean that it is directly connected to or accessing the other element, or there may be intervening elements present between the two elements. On the other hand, when an element is mentioned as being "directly connected" to or "directly accessing" another element, it is to be understood that there are no intervening elements present.

The term "module" as used herein may imply a unit including one of hardware, software, and firmware, or a combination thereof. The term "module" may be interchangeably used with terms, such as unit, logic, logical block, component, circuit, and the like. A module as described herein may be a minimum unit of an integrally constituted component or may be a part thereof. The module may be a minimum unit for performing one or more functions or may be a part thereof. The module may be mechanically or electrically implemented. For example, the module as described herein includes at least one of an application-specific IC (ASIC) chip, a field-programmable gate arrays (FPGAs), and a programmable-logic device, which are known or will be developed and which perform certain operations.

By the term "substantially" it is meant that the recited characteristic, parameter, or value need not be achieved exactly, but that deviations or variations, including, but not limited to, for example, tolerances, measurement errors, measurement accuracy limitations and other factors known to persons of ordinary skill in the art, may occur in amounts that do not preclude the effect the characteristic was intended to provide.

Unless otherwise defined, all terms, including technical and scientific terms, used herein have the same meaning as commonly understood by those of ordinary skill in the art to which various embodiments of the present disclosure belong. It will be further understood that terms, such as those defined in commonly used dictionaries, should be interpreted as having meanings that are consistent with their meaning in the context of the relevant art and the various embodiments of the present disclosure, and should not be interpreted in an idealized or overly formal sense unless expressly so defined herein.

An electronic device as used herein may be a device including, but not limited to, an antenna capable of performing a communication function in at least one frequency band. For example, the electronic device may be a smart phone, a tablet personal computer (PC), a mobile phone, a video phone, an e-book reader, a desktop PC, a laptop PC, a netbook computer, a personal digital assistant (PDA), a portable multimedia player (PMP), a moving picture experts group phase 1 or phase 2 (MPEG-1 or MPEG-2) audio layer 3 (MP3) player, a mobile medical device, a camera, and a wearable device (e.g., a head-mounted-device (HMD), such as electronic glasses, electronic clothes, an electronic bracelet, an electronic necklace, an electronic appcessory, an electronic tattoo, a smart watch, and the like).

The electronic device may be a smart home appliance having an antenna. For example, the smart home appliance may include at least one of a television (TV), a digital versatile disc (DVD) player, an audio player, a refrigerator, an air conditioner, a cleaner, an oven, a microwave oven, a washing machine, an air purifier, a set-top box, a TV box (e.g., Samsung HomeSync®, Apple TV®, or Google TV®), a game console, an electronic dictionary, an electronic key, a camcorder, and an electronic picture frame.

The electronic device including the antenna may be one of various medical devices (e.g., magnetic resonance angiography (MRA), magnetic resonance imaging (MRI), computed tomography (CT), imaging equipment, an ultrasonic instrument, and the like), a navigation device, a global positioning system (GPS) receiver, an event data recorder (EDR), a flight data recorder (FDR), a car infotainment device, electronic equipment for a ship (e.g., a vessel navigation device, a gyro compass, and the like), avionics, a security device, a car head unit, an industrial or domestic robot, an automatic teller machine (ATM), a point of sales (POS) device, and the like.

The electronic device may be part of at least one of an item of furniture or a building/structure including an antenna. The electronic device may be an electronic board, an electronic signature input device, a projector, or any of various measurement machines (e.g., water supply, electricity, gas, a propagation measurement machine, and the like).

The electronic device may be one or more combinations of the aforementioned various devices. In addition, the electronic device may be a flexible device. Moreover, the electronic device is not limited to the aforementioned devices.

Hereinafter, an electronic device according to various embodiments will be described with reference to the accompanying drawings. The term 'user' used in the various embodiments may refer to a person who uses the electronic device or a device which uses the electronic device (e.g., an artificial intelligence (AI) electronic device).

FIG. 1 illustrates a view of a network environment including an electronic device, according to an embodiment of the present disclosure.

Referring to FIG. 1, the electronic device 100 includes a bus 110, a processor 120, a memory 130, an input/output interface 150, a display 160, and a communication interface 170. In various embodiments of the present disclosure, the electronic device 100 can omit at least one of the components or further include another component.

The bus 110 includes a circuit for connecting the components (e.g., the processor 120, the memory 130, the input/output interface 150, the display 160, and the communication interface 170) and delivering communications (e.g., a control message) therebetween.

The processor 120 includes one or more of a central processing unit (CPU), an application processor (AP), and a communication processor (CP). The processor 120 processes an operation or data on control of and/or communication with another component of the electronic device 100.

The processor 120, which is connected to the LTE network, determines whether a call is connected over the CS service network using caller identification information (e.g., a caller phone number) of the CS service network (e.g., the 2G/3G network). For example, the processor 120 receives incoming call information (e.g., a CS notification message or a paging request message) of the CS service network over the LTE network (e.g., circuit-switched fallback (CSFB)). For example, the processor 120 being connected to the LTE network receives incoming call information (e.g., a paging request message) over the CS service network (e.g., single radio LTE (SRLTE)).

When receiving the incoming call information (e.g., a CS notification message or a paging request message) of the CS service network over the LTE network, the processor 120 obtains caller identification information from the incoming call information. The processor 120 displays the caller identification information on the display 160. The processor 120 determines whether to connect the call based on input information corresponding to the caller identification information displayed on the display 160. For example, when detecting input information corresponding to an incoming call rejection, through the input/output interface 150, the processor 120 restricts the voice call connection and maintains the LTE network connection. For example, when detecting input information corresponding to an incoming call acceptance, through the input/output interface 150, the processor 120 connects the voice call by connecting to the CS service network.

When receiving the incoming call information (e.g., a CS notification message or a paging request message) of the CS service network over the LTE network, the processor 120 obtains caller identification information from the incoming call information. The processor 120 determines whether to connect the call by comparing the caller identification information with a reception control list. For example, when the caller identification information is included in a first reception control list (e.g., a blacklist), the processor 120 restricts the voice call connection and maintains the connection to the LTE network. For example, when the caller identification information is not included in the first reception control list (e.g., the blacklist), the processor 120 connects the voice call by connecting to the CS service network. For example, when the caller identification information is included in a second reception control list (e.g., a white list), the processor 120 connects the voice call by connecting to the CS service network.

When receiving the incoming call information (e.g., a paging request message) of the CS service network over the LTE network, the processor 120 sends an incoming call response message (e.g., a paging response message) to the CS service network. The processor 120 suspends the LTE service and receives the caller identification information (e.g., a Circuit-switched Call (CC) setup message) from the CS service network. The processor 120 determines whether to connect the call by comparing the caller identification information with the reception control list. For example, when the caller identification information is included in the first reception control list (e.g., the blacklist), the processor 120 restricts the voice call connection and resumes the LTE network connection. For example, when the caller identification information is not included in the first reception control list (e.g., the blacklist), the processor 120 connects the voice call by connecting to the CS service network. For example, when the caller identification information is included in the second reception control list (e.g., the white list), the processor 120 connects the voice call by connecting to the CS service network.

The memory 130 can include volatile and/or nonvolatile memory. The memory 130 stores commands or data (e.g., the reception control list) relating to at least another component of the electronic device 100. The memory 130 may store software and/or a program 140. The program 140 may include, for example, a kernel 141, middleware 143, an application programming interface (API) 145, and/or application programs (or "applications") 147. At least some of the kernel 141, the middleware 143, and the API 145 may be referred to as an operating system (OS).

The kernel 141 controls or manages system resources (e.g., the bus 110, the processor 120, or the memory 130) used for performing an operation or function implemented by the other programs (e.g., the middleware 143, the API 145, or the applications 147). Furthermore, the kernel 141 provides an interface through which the middleware 143, the API 145, or the applications 147 connects the individual elements of the electronic device 100 to control or manage the system resources.

The middleware 143 functions as an intermediary for allowing the API 145 or the applications 147 to communicate with the kernel 141 to exchange data.

In addition, the middleware 143 processes one or more task requests received from the applications 147 according to priorities thereof. For example, the middleware 143 assigns priorities for using the system resources (e.g., the bus 110, the processor 120, the memory 130, etc.) of the electronic device 100, to at least one of the applications 147. For example, the middleware 143 may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function (e.g., an instruction) for file control, window control, image processing, text control, etc.

The input/output interface 150 functions as an interface that transfers instructions or data input from a user or another external device to the other element(s) of the electronic device 100. Furthermore, the input/output interface 150 outputs the instructions or data received from the other element(s) of the electronic device 100 to the user or an external electronic device.

The display 160 may include a liquid crystal display (LCD), a light emitting diode (LED) display, an organic LED (OLED) display, a micro electro mechanical system (MEMS) display, an electronic paper display, etc. The display 160 displays various types of content (e.g., a text, images, videos, icons, symbols, etc.) for the user. The display 160 may include a touch screen and receive, for example, a touch, a gesture, proximity, a hovering input, etc., using an electronic pen or the user's body part. The display 160 may display a web page.

The communication interface 170 can establish a communication between the electronic device 100 and an external electronic device (e.g., a first external electronic device 102, a second external electronic device 104, or a server 106). For example, the communication interface 170 can communicate with the first external electronic device 102, the second external electronic device 104, or the server 106 in connection to the network 162 through wireless communication or wired communication. For example, the wireless communication can conform to a cellular communication protocol including at least one of LTE, LTE-Advanced (LTE-A), CDMA, WCDMA, universal mobile telecommunication system (UMTS), WiBro, and GSM.

The wired communication can include at least one of universal serial bus (USB), high definition multimedia interface (HDMI), recommended standard 232 (RS-232), and plain old telephone service (POTS).

The network 162 can include at least one of telecommunications networks, for example, a computer network (e.g., local area network (LAN) or wide area network (WAN)), Internet, and a telephone network.

The electronic device 100 provides the LTE service in the single radio environment by use of at least one module functionally or physically separated from the processor 120. Various embodiments of the present disclosure will be described with reference to a display that includes a bent or curved area and is applied to a housing of an electronic device, in which a non-metal member and a metal member (e.g., a metal bezel) are formed through dual injection molding, but are not limited thereto. For example, the display may be applied to a housing, in which a metal member or a non-metal member is formed of a single material.

Each of the first and second external electronic devices 102 and 104 may be a type of device that is the same as or different from the electronic device 101. According to one embodiment, the server 106 may include a group of one or more servers. According to various embodiments, all or some of the operations to be executed by the electronic device 101 may be executed by another electronic device or a plurality of other electronic devices (e.g., the electronic devices 102 and 104 or the server 106). According to one embodiment, in the case where the electronic device 101 may perform a certain function or service automatically or by request, the electronic device 101 may request some functions that are associated therewith from the other electronic devices (e.g., the electronic devices 102 and 104 or the server 106) instead of or in addition to executing the function or service by itself. The other electronic devices (e.g., the electronic devices 102 and 104 or the server 106) may execute the requested functions or additional functions, and may transmit the results to the electronic device 101. The electronic device 101 may provide the requested functions or services by processing the received results. For this purpose, for example, a cloud computing technique, a distributed computing technique, or a client-server computing technique may be used.

Various embodiments of the present disclosure will be described with reference to a display that includes a bent or curved area and is applied to a housing of an electronic device, in which a non-metal member and a metal member (e.g., a metal bezel) are formed through dual injection molding, but are not limited thereto. For example, the display may be applied to a housing, in which a metal member or a non-metal member is formed of a single material.

Figure 2:
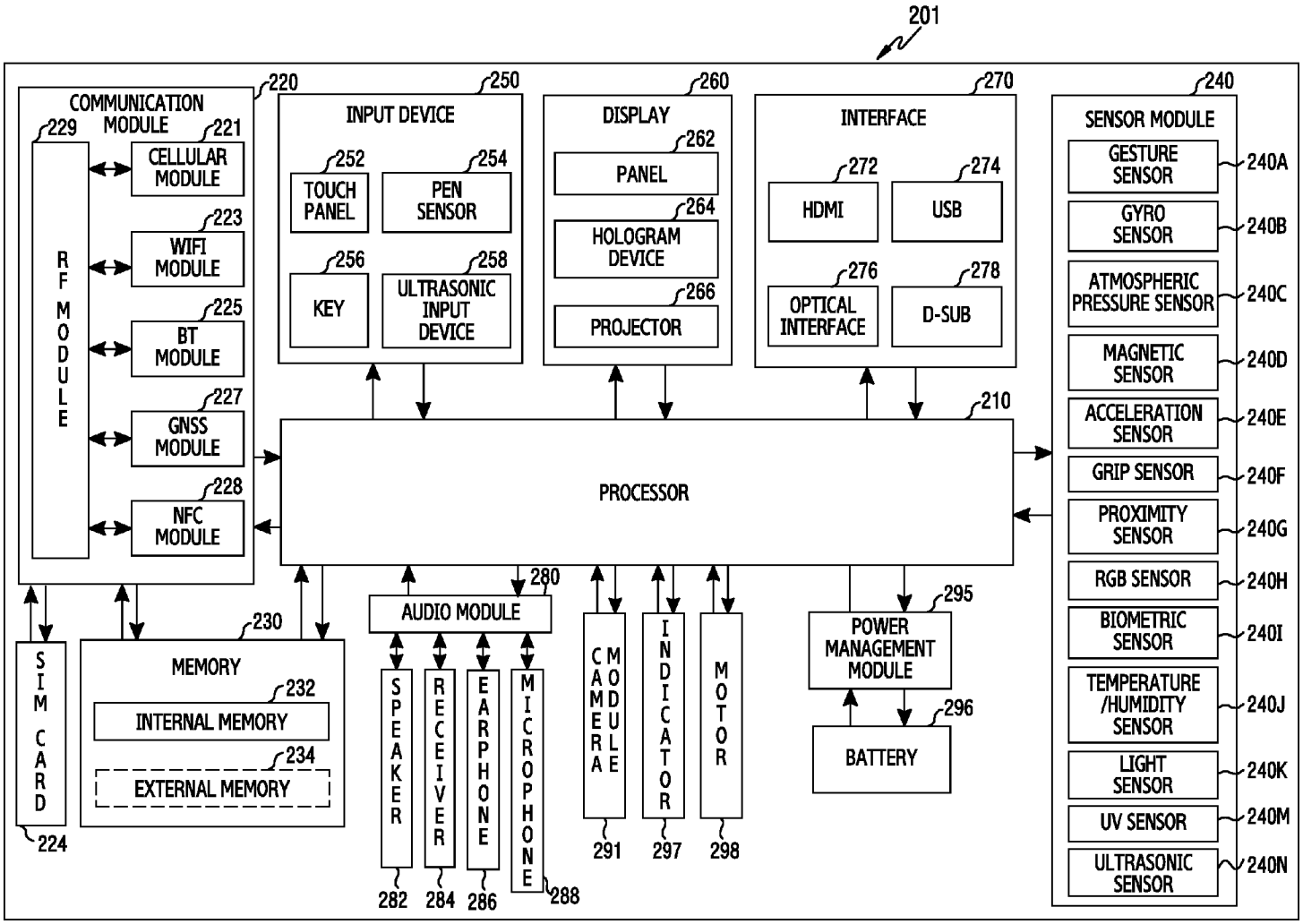
FIG. 2 illustrates a block diagram of an electronic device according to various embodiments of the present disclosure.

FIG. 2 illustrates a diagram of a configuration of an electronic device 201, according to an embodiment of the present disclosure.

Referring to FIG. 2, a configuration of the electronic device 201 is provided. The electronic device 201 may include all or some of the components described with reference to the electronic device 101 of FIG. 1. The electronic device 201 includes at least one application processor (AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 controls a plurality of hardware or software elements connected to the AP 210 by driving an operating system (OS) or an application program. The AP 210 processes a variety of data, including multimedia data, and performs arithmetic operations. The AP 210 may be implemented, for example, with a system on chip (SoC). The AP 210 may further include a graphical processing unit (GPU).

The communication module 220 performs data transmission/reception in communication between the external electronic device 104 or the server 106 which may be connected with the electronic device 201 through the network 162. The communication module 220 includes a cellular module 221, a Wi-Fi module 223, a BT module 225, a global navigation satellite system (GNSS) or GPS module 227, a NFC module 228, and a radio frequency (RF) module 229.

The cellular module 221 provides a voice call, a video call, a text service, an internet service, and the like, through a communication network (e.g., LTE, LTE-A, CDMA, WCDMA, UMTS, WiBro, and GSM, and the like). In addition, the cellular module 221 identifies and authenticates the electronic device 201 within the communication network by using the SIM card 224. The cellular module 221 may perform at least some of functions that can be provided by the AP 210. For example, the cellular module 221 may perform at least some of multimedia control functions.

The cellular module 221 includes a communication processor (CP). Further, the cellular module 221 may be implemented, for example, with an SoC. Although elements, such as the cellular module 221 (e.g., the CP), the memory 230, and the power management module 295 are illustrated as separate elements with respect to the AP 210 in FIG. 2, the AP 210 may also be implemented such that at least one part (e.g., the cellular module 221) of the aforementioned elements is included in the AP 210.

The AP 210 or the cellular module 221 loads an instruction or data, which is received from each non-volatile memory connected thereto or at least one of different elements, to a volatile memory and processes the instruction or data. In addition, the AP 210 or the cellular module 221 stores data, which is received from at least one of different elements or generated by at least one of different elements, into the non-volatile memory.

Each of the Wi-Fi module 223, the BT module 225, the GNSS module 227, and the NFC module 228 includes a processor for processing data transmitted/received through a corresponding module. Although the cellular module 221, the Wi-Fi module 223, the BT module 225, the GNSS module 227, and the NFC module 228 are illustrated in FIG. 2 as separate blocks, at least some (e.g., two or more) of the cellular module 221, the Wi-Fi module 223, the BT module 225, the GNSS module 227, and the NFC module 228 may be included in one integrated chip (IC) or IC package. For example, at least some of processors corresponding to the cellular module 221, the Wi-Fi module 223, the BT module 225, the GNSS module 227, and the NFC module 228 (e.g., a communication processor corresponding to the cellular module 221 and a Wi-Fi processor corresponding to the Wi-Fi module 223) may be implemented with an SoC.

The RF module 229 transmits/receives data, for example an RF signal. The RF module 229 may include, for example, a transceiver, a power amp module (PAM), a frequency filter, a low noise amplifier (LNA), and the like. In addition, the RF module 229 may further include a component for transmitting/receiving a radio wave on a free space in wireless communication, for example, a conductor, a conducting wire, and the like. Although it is illustrated in FIG. 2 that the cellular module 221, the Wi-Fi module 223, the BT module 225, the GNSS module 227, and the NFC module 228 share one RF module 229, a at least one of the cellular module 221, the Wi-Fi module 223, the BT module 225, the GNSS module 227, the NFC module 228 may transmit/receive an RF signal via a separate RF module.

The SIM card 224 may be inserted into a slot formed at a specific location of the electronic device 201. The SIM card 224 includes unique identification information (e.g., an integrated circuit card identifier (ICCID)) or subscriber information (e.g., an international mobile subscriber identity (IMSI)).

The memory 230 includes an internal memory 232 or an external memory 234.

The internal memory 232 may include, for example, at least one of a volatile memory (e.g., a dynamic random access memory (DRAM), a static RAM (SRAM), a synchronous dynamic RAM (SDRAM), and the like) or a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, a not or (NOR) flash memory, and the like). The internal memory 232 may be a solid state drive (SSD).

The external memory 234 may include a flash drive, and may further include, for example, compact flash (CF), secure digital (SD), micro-SD, mini-SD, extreme digital (xD), memory stick, and the like. The external memory 234 may be operatively coupled to the electronic device 201 via various interfaces.

The electronic device 201 may further include a storage unit (or a storage medium), such as a hard drive.

The sensor module 240 measures a physical quantity or detects an operation state of the electronic device 201, and converts the measured or detected information into an electric signal. The sensor module 240 includes, for example, at least one of a gesture sensor 240A, a gyro sensor 240B, a barometric pressure sensor or air sensor 240C, a magnetic sensor 240D, an acceleration sensor 240E, a grip sensor 240F, a proximity sensor 240G, a color sensor 240H (e.g., a red, green, blue (RGB) sensor), a biometric sensor 240I, a temperature/humidity sensor 240J, an illumination/illuminance sensor 240K, an ultraviolet (UV) sensor 240M and ultrasonic sensor 240N.

The ultrasonic sensor 240N may include at least one ultrasonic transducer. The ultrasonic sensor 240N may include a contact type ultrasonic transducer (for example, an enclosed type ultrasonic transducer) and a non-contact type ultrasonic transducer (for example, a resonant type ultrasonic transducer), each of which are described in greater detail below. The contact type ultrasonic transducer and the non-contact type ultrasonic transducer may be controlled to be exclusively or simultaneously operated under a control of the processors 120, 220.

Additionally or alternatively, the sensor module 240 may include, for example, an E-node sensor, an electromyography (EMG) sensor, an electroencephalogram (EEG) sensor, an electrocardiogram (ECG) sensor, a fingerprint sensor, and the like.

The sensor module 240 may further include a control circuit for controlling at least one or more sensors included therein.

The input device 250 includes a touch panel 252, a (digital) pen sensor 254, a key 256, or an ultrasonic input unit 258.

The touch panel 252 recognizes a touch input, for example, by using at least one of an electrostatic type configuration, a pressure-sensitive type configuration, and an ultrasonic type configuration. The touch panel 252 may further include a control circuit. In the instance where the touch panel is of the electrostatic type, not only is physical contact recognition possible, but proximity recognition is also possible. The touch penal 252 may further include a tactile layer, which provides the user with a tactile reaction.

The (digital) pen sensor 254 may include, for example, a recognition sheet which is a part of the touch panel or is separated from the touch panel. The key 256 may include, for example, a physical button, an optical key, or a keypad. The ultrasonic input device 258 may detect ultrasonic waves generated by an input tool through the microphone 288, and may confirm data corresponding to the detected ultrasonic waves.

The (digital) pen sensor 254 may be implemented, for example, by using the same or similar method of receiving a touch input of the user or by using an additional sheet for recognition.

The key 256 may be, for example, a physical button, an optical key, a keypad, or a touch key.

The ultrasonic input unit 258 is a device by which the electronic device 201 detects a reflected sound wave through a microphone 288 and is capable of radio recognition. For example, a an ultrasonic signal, which may be generated by using a pen, may be reflected off an object and detected by the microphone 288.

The electronic device 201 may use the communication module 220 to receive a user input from an external device (e.g., a computer or a server) connected thereto.

The display 260 includes a panel 262, a hologram 264, or a projector 266.

The panel 262 may be, for example, a liquid-crystal display (LCD), an active-matrix organic light-emitting diode (AM-OLED), and the like. The panel 262 may be implemented, for example, in a flexible, transparent, or wearable manner. The panel 262 may be constructed as one module with the touch panel 252.

The hologram device 264 uses an interference of light and displays a stereoscopic image in the air.

The projector 266 displays an image by projecting a light beam onto a screen. The screen may be located inside or outside the electronic device 201.

The display 260 may further include a control circuit for controlling the panel 262, the hologram device 264, or the projector 266.

The interface 270 includes, for example, an HDMI 272, a USB 274, an optical communication interface 276, or a D-subminiature (D-sub) 278. The interface 270 may be included, for example, in the communication interface 160 of FIG. 1. Additionally or alternatively, the interface 270 may include, for example, mobile high-definition link (MHL), SD/multi-media card (MMC) or infrared data association (IrDA).

The audio module 280 bilaterally converts a sound and an electric signal. At least some elements of the audio module 280 may be included in the input/output interface 150 of FIG. 1. The audio module 280 converts sound information which is input or output through a speaker 282, a receiver 284, an earphone 286, the microphone 288, and the like.

The speaker 282 may output a signal of an audible frequency band and a signal of an ultrasonic frequency band. Reflected waves of an ultrasonic signal emitted from the speaker 282 may be received, or a signal of an external audible frequency band may also be received.

The camera module 291 is a device for image and video capturing, and may include one or more image sensors (e.g., a front sensor or a rear sensor), a lens, an image signal processor (ISP), or a flash (e.g., an LED or a xenon lamp). In certain instances, it may prove advantageous to include two or more camera module.

The power management module 295 manages power of the electronic device 201. The power management module 295 may include a power management integrated circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge measures, for example, a residual quantity of the battery 296 and a voltage, current, and temperature during charging. The battery 296 stores or generates electricity and supplies power to the electronic device 201 by using the stored or generated electricity. The battery 296 may include a rechargeable battery or a solar battery.

The indicator 297 indicates a specific state, for example, a booting state, a message state, a charging state, and the like, of the electronic device 201 or a part thereof (e.g., the AP 210).

The motor 298 converts an electric signal into a mechanical vibration.

The electronic device 201 includes a processing unit (e.g., a GPU) for supporting mobile TV. The processing unit for supporting mobile TV processes media data according to a protocol of, for example, digital multimedia broadcasting (DMB), digital video broadcasting (DVB), media flow, and the like.

Each of the aforementioned elements of the electronic device 201 may consist of one or more components, and names thereof may vary depending on a type of the electronic device 201. The electronic device 201 may include at least one of the aforementioned elements. Some of the elements may be omitted, or additional other elements may be further included. In addition, some of the elements of the electronic device 201 may be combined and constructed as one entity, so as to equally perform functions of corresponding elements before combination.

At least some parts of a device (e.g., modules or functions thereof) or method (e.g., operations) may be implemented with an instruction stored in a computer-readable storage media for example. The instruction may be executed by the processor 210, to perform a function corresponding to the instruction. The computer-readable storage media may be, for example, the memory 230. At least some parts of the programming module may be implemented (e.g., executed), for example, by the processor 210. At least some parts of the programming module may include modules, programs, routines, a set of instructions, processes, and the like, for performing one or more functions.

Figure 3:
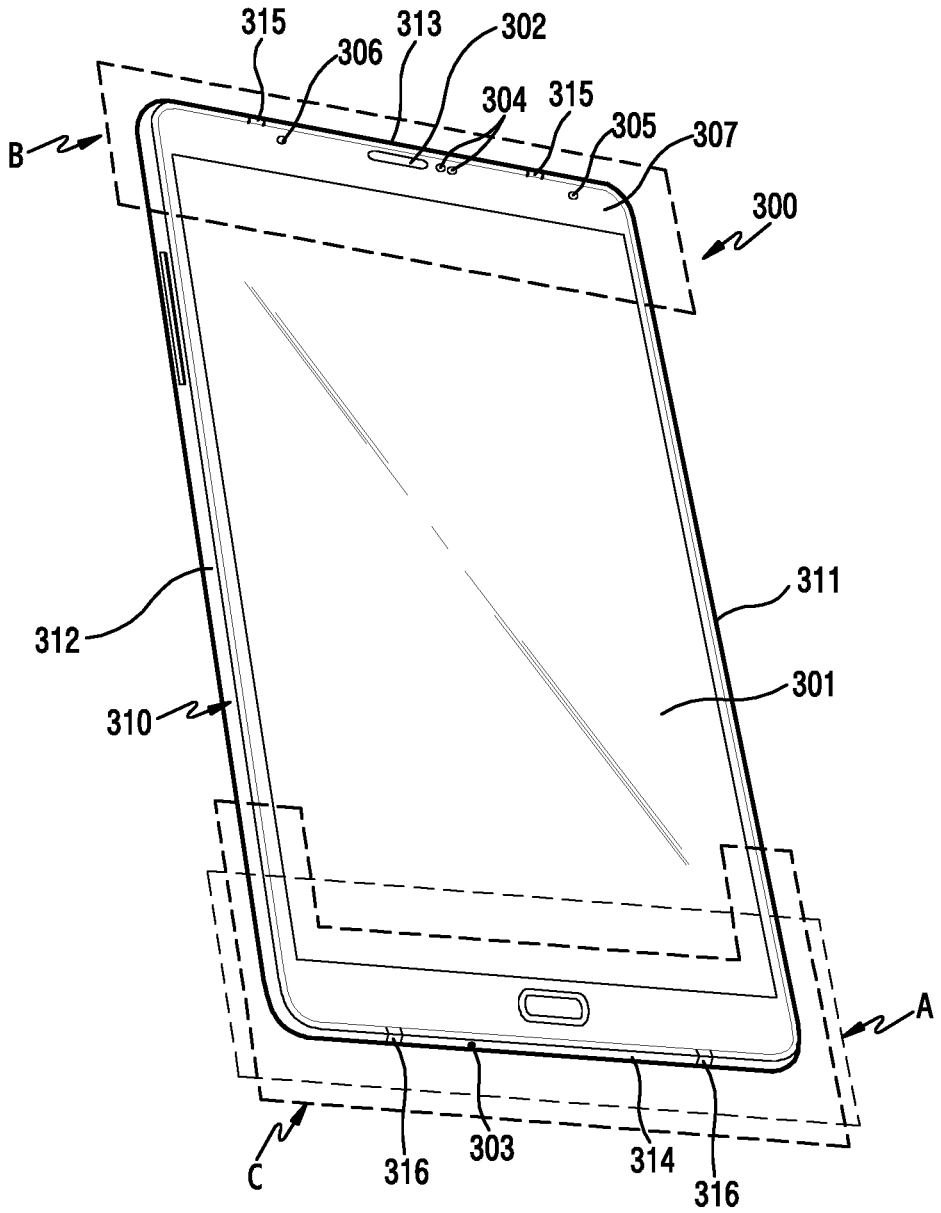
FIG. 3 illustrates a perspective view of an electronic device according to various embodiments of the present disclosure.

FIG. 3 illustrates a perspective view of an electronic device 300 according to various embodiments of the present disclosure.

Referring to FIG. 3, a display 301 may be provided on the front face 307 of the electronic device 300. A speaker device 302 may be installed above the display 301 so as to receive a voice of a counterpart. A microphone device 303 may be installed below the display 301 so as to transmit a voice of the user of the electronic device.

According to one embodiment, components for conducting various functions of the electronic device 300 may be arranged around the speaker device 302. The components may include one or more sensor module 304. The sensor module 304 may include at least one of, for example, an illuminance sensor (e.g., an optical sensor), a proximity sensor, an infrared sensor, and an ultrasonic sensor. According to one embodiment, the components may include a camera device 305. According to one embodiment, the components may include an LED indicator 306 that informs the user of the status information of the electronic device 300.

According to various embodiments, the electronic device 300 may include a metal bezel 310 (that may serve as at least a partial region of, for example, a metal housing). According to one embodiment, the metal bezel 310 may be arranged along the rim of the electronic device 300, and may be disposed to expand to at least a partial region of the rear face of the electronic device 300 that extends from the rim. According to one embodiment, the metal bezel 310 is defined by the thickness of the electronic device 300 along the rim of the electronic device 300, and may be formed in a loop shape. Without being limited thereto, however, the metal bezel 310 may be formed to serve as at least a portion of the thickness of the electronic device 300. According to one embodiment, the metal bezel 310 may be formed on only a portion of the rim of the electronic device 300. According to one embodiment, the metal bezel 310 may include one or more split portions 315 and 316. According to one embodiment, unit bezel sections split by the respective split portions 315 and 316 may be utilized as antenna radiators that operate in one or more frequency bands.

According to various embodiments, the metal bezel 310 may have a loop shape along the rim, and may be arranged to serve as the whole or a part of the thickness of the electronic device 300. According to one embodiment, when viewed from the front side of the electronic device 300, the metal bezel 310 may include a right bezel section 311, a left bezel section 312, an upper bezel section 313, and a lower bezel section 314. Here, the above-mentioned lower bezel section 314 may serve as a unit bezel section that is formed by a pair of split portions 316.

According to various embodiments, the antenna device may be disposed in a lower region (region A) of the electronic device 300. According to one embodiment, the lower bezel section 314 may be used as the main antenna radiator by the pair of split portions 316. According to one embodiment, the lower bezel section 314 may serve as an antenna radiator that operates in at least two operating frequency bands according to a power feeding position. According to one embodiment, the right bezel section 311 and the left bezel section 312 may be capacitively connected with the lower bezel section 314, thereby contributing to the improvement of a radiation performance.

According to various embodiments, the lower bezel section 314 may be used as a sensing member in addition to being used as an antenna radiator. This is because the lower bezel section 314 is formed of a metal member. According to one embodiment, the lower bezel section 314 may be utilized as a grip sensor configured to detect the gripping of the electronic device by a user's hand. According to one embodiment, the lower bezel section 314 may also be utilized as an electrocardiography sensor, an ordinary touch sensor, a temperature sensor (e.g., a probe for a temperature sensor), or an underwater recognition sensor (e.g., a waterlogging recognition sensor).

According to various embodiments, the antenna device of the present disclosure is merely an exemplary configuration. The above-mentioned functions of the lower bezel section 314 may be substituted by the functions performed by the upper bezel section 313 split by another split portion 315, or may be performed together with the functions performed by the upper bezel sections 313. In such a case, region B in FIG. 3 may be utilized as an antenna device. In addition, such a configuration is in the form of being split by another split portion formed in the right bezel section 311 and/or the left bezel section 312 of the metal bezel 310 of FIG. 3, and the lower bezel section, in which at least a portion of the right bezel section and/or the left bezel section of region C is included, may be utilized as an antenna radiator.

According to various embodiments, the lower bezel section 314 divided into unit bezel sections by a pair of split portions 316 may be utilized as an antenna radiator. According to one embodiment, at least one of the left bezel section 312 and the right bezel section 311, which are disposed to be spaced apart from each other at a predetermined interval by the respective split portions 316, may also be capacitively connected with the lower bezel section 314 to be utilized as a parasitic antenna radiator for improving the radiation performance of the lower bezel section 314.

According to various embodiments, the lower bezel section 314 and the left bezel section 312 or the lower bezel section 314 and the right bezel section 311 are capacitively connected with each other rather than being connected via an electric contact, and may be disposed to be capable of being coupled through a predetermined electric connection member. According to one embodiment, with this coupling structure, the lower bezel section 314 utilized as the antenna radiator may be improved in terms of radiation performance by the left bezel section 312 and/or the right bezel section 311, which are connected thereto through a coupling manner.

According to various embodiments, the lower bezel section 314 may be configured not to be affected by the left bezel section 312 and/or the right bezel section 311 by the coupling structure when a sensing function (e.g., a grip sensing function, an electrocardiography sensing function, an ordinary touch sensing function, a temperature sensing function, or an underwater recognition sensing function) to be performed. According to one embodiment, the lower bezel section 314 is electrically separated from the left bezel section 312 and the right bezel section 311 by the coupling structure so as to prevent a leakage current of a standard level or more from being generated so that an electric shock accident can be prevented in advance.

According to various embodiments, when a use frequency for a first function is applied, the lower bezel section 314 may operate as a short circuit that is connected to the left bezel section 312 and/or the right bezel section 311 by the coupling structure. According to one embodiment, when a use frequency for a second function is applied, the lower bezel section 314 may operate as an open circuit that is separated from the left bezel section 312 and/or the right bezel section 311 by the coupling structure.

According to various embodiments, when a frequency used for the transmission/reception of an RF signal for an antenna radiator is applied, the lower bezel section 314 may operate as a short circuit that is connected to the left bezel section 312 and/or the right bezel section 311 by the coupling structure. According to one embodiment, when a frequency other than the frequency used for the transmission/reception of an RF signal for an antenna radiator is applied, the lower bezel section 314 may operate as an open circuit that is separated from the left bezel section 312 and/or the right bezel section 311 by the coupling structure.

According to various embodiments, when a high frequency function for an antenna radiator is applied, the lower bezel section 314 may operate as a short circuit that is connected to the left bezel section 312 and/or the right bezel section 311 by the coupling structure. According to one embodiment, when DC and relatively low frequency functions (e.g., a function operating in an operation frequency band of 0 to several MHz) are applied, the lower bezel section 314 may operate as an open circuit that is separated from the left bezel section 312 and/or the right bezel section 311 by the coupling structure.

According to various embodiments, the lower bezel section 314 is used as a main antenna radiator, and the lower bezel section 312 and/or right bezel section 311 is utilized as a parasitic antenna radiator that supports the main antenna radiator, but is not limited thereto. For example, at least one of the right bezel section 311 and the left bezel section 312 may also be independently fed with power to be used as an additional antenna radiator.

Hereinafter, an antenna device according to an exemplary embodiment of the present disclosure will be described in detail.

Figure 4:
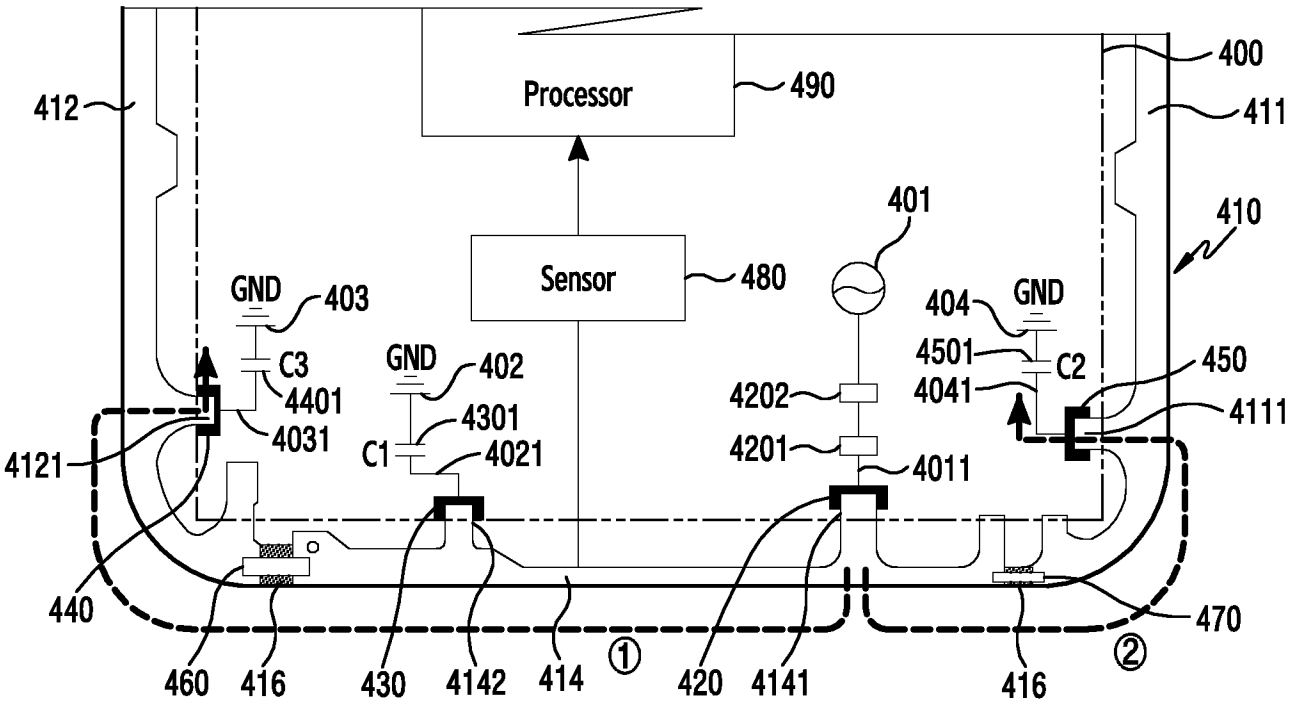
FIG. 4 illustrates a diagram of a configuration of an antenna device according to various embodiments of the present disclosure.

FIG. 4 illustrates a diagram of a configuration of an antenna device according to various embodiments of the present disclosure.

According to various embodiments, the metal bezel 410 of FIG. 4 is an embodiment of a metal bezel that is similar to, or different from, the metal bezel 310 of FIG. 3.

Referring to FIG. 4, when viewed from the front side, the metal bezel 410 may include a right bezel section 411, a left bezel section 412, and a lower bezel section 414. According to one embodiment, the lower bezel section 414 may be maintained in the state where the lower bezel section 414 is separated from the right bezel section 411 and the left bezel section 412 by a pair of split portions 416 that are formed at a predetermined interval. According to one embodiment, the pair of split portions 416 may be formed of a dielectric material. According to one embodiment, the pair of split portions 416 may be formed by dual injection molding or insert molding a synthetic resin material to the metal bezel 410 made of a metallic material. Without being limited thereto, however, various insulative materials may be applied to the pair of split portions 416.

According to various embodiments, in the lower bezel section 414, a power feeding piece 4141 may be integrally formed with the lower bezel section 414, and the power feeding piece 4141 may be fed with power by a power feeding unit 401 of a board (PCB) 400. According to one embodiment, the power feeding piece 4141 of the lower bezel section 414 may be connected to the power feeding unit of the board 400 merely through an operation of installing the board 400 to the electronic device, or may be electrically connected to the power feeding unit of the board 400 by a separate electric connection member (e.g., a C-clip).

According to various embodiments, a power feeding pad 420 may be disposed on the board 400, and may be electrically connected with the power feeding piece 4141 of the lower bezel section 414. According to one embodiment, a first electric path (e.g., a wiring line) 4011 may be formed from the power feeding pad 420 to the power feeding unit 401. According to one embodiment, since the power feeding pad 420 of the board 400 is configured to be directly and electrically contacted with the metal bezel 410 that forms the exterior of the electronic device, the first electric path 4011 may further include a first electric shock prevention circuit 4201 for preventing electric shock and performing Electro-Static Discharge (ESD) and a matching circuit 4202 configured to tune the antenna radiator to a desired frequency band.

According to various embodiments, in the lower bezel section 414, a first ground piece 4142 may be integrally formed with the lower bezel section 414 at a position spaced apart from the power feeding piece 4141, and the first ground piece 4142 may be grounded to a first ground portion 402 of the board 400. According to one embodiment, the first ground piece 4142 of the lower bezel section 414 may be grounded to the first ground portion 402 of the board 400 merely through an operation of installing the board 400 to the electronic device, or may be electrically connected to the first ground portion of the board 400 by a separate electric connection member (e.g., a C-clip).

According to various embodiments, a first ground pad 430 may be disposed on the board 400, and may be electrically connected with the first ground piece 4142 of the lower bezel section 414. According to one embodiment, a second electric path (e.g., a wiring line) 4021 may be formed from the first ground pad 430 to the first ground portion 402. According to one embodiment, since the first ground pad 430 of the board 400 is configured to be directly electrically contacted with the metal bezel 410 that forms the exterior of the electronic device, the second electric path 4021 may further include a second electric shock prevention circuit 4301 (e.g., a capacitor) for preventing an electric shock and performing ESD.

According to various embodiments, in the left bezel section 412, a second ground piece 4121 may be integrally formed with the left bezel section 412 at a position spaced apart from the split 416, and the second ground piece 4121 may be grounded to a second ground portion 403 of the board (PCB) 400. According to one embodiment, the second ground piece 4121 of the left bezel section 412 may be grounded to the second ground portion 403 of the board 400 merely through an operation of installing the board 400 to the electronic device, or may be electrically connected to the second ground portion of the board 400 by a separate electric connection member (e.g., a C-clip).

According to various embodiments, a second ground pad 440 may be disposed on the board 400, and may be electrically connected with the second ground piece 4121 of the left bezel section 412. According to one embodiment, a third electric path (e.g., a wiring line) 4031 may be formed from the second ground pad 440 to the second ground portion 403. According to one embodiment, since the second ground pad 440 of the board 400 is configured to be directly and electrically contacted with the metal bezel 410 that forms the exterior of the electronic device, the third electric path 4031 may further include a third electric shock prevention circuit 4401 (e.g., a capacitor) for preventing electric shock and performing ESD.

According to various embodiments, in the right bezel section 411, a third ground piece 4111 may be integrally formed with the right bezel section 411 at a position spaced apart from the split 416, and the third ground piece 4111 may be grounded to a third ground portion 404 of the board (PCB) 400. According to one embodiment, the third ground piece 4111 of the right bezel section 411 may be grounded to the third ground portion 404 of the board 400 merely through an operation of installing the board 400 to the electronic device, or may be electrically connected to the third ground portion 404 of the board 400 by a separate electric connection member (e.g., a C-clip).

According to various embodiments, a third ground pad 450 may be disposed on the board 400, and may be electrically connected with the third ground piece 4111 of the right bezel section 411. According to one embodiment, a fourth electric path (e.g., a wiring line) 4041 may be formed from the third ground pad 450 to the third ground portion 404. According to one embodiment, since the third ground pad 450 of the board 400 is configured to be directly and electrically contacted with the metal bezel 410 that forms the exterior of the electronic device, the fourth electric path 4041 may further include a fourth electric shock prevention circuit 4501 (e.g., a capacitor) for preventing electric shock and performing ESD.

According to various embodiments, the lower bezel section 414 may operate as a multiple-band antenna radiator that includes a loop type radiation region (region ① of FIG. 4) that passes through the power feeding piece 4141 and is grounded through the second ground pad 440 of the left bezel section 412, and a loop type radiation region (region ② of FIG. 4) that passes through the power feeding piece 4141 and is grounded through the third ground pad 450 of the right bezel section 411.

According to various embodiments, a sensor 480 controlled by a processor 490 of the electronic device may be electrically connected to the lower bezel section 414. According to one embodiment, the lower bezel section 414 may be used as a sensing member in addition to being used as an antenna radiator.

According to various embodiments, the sensor 480 may include a grip sensor (e.g., the lower bezel section 414) configured to detect the user's gripping of the electronic device. According to one embodiment, when the sensor is used as a grip sensor and the grip sensor operates by an approach of a human body, the processor 490 may determine that the human body comes close to the electronic device, and may operate to automatically lower the power to a level that is not harmful to a human body (specific absorption rate (SAR)) (SAR power limit backoff). According to one embodiment, when the sensor is used as a grip sensor and the grip sensor operates by an approach of a human body, the processor 490 may determine that the human body comes close to the electronic device, and may control an antenna tuner or a tuning switch in order to tune the resonance frequency of an antenna device that suffers from a performance degradation to a frequency band where the electronic device is performing communication. According to one embodiment, when the access of a human body is detected, the processor 490 may use another antenna to which no human body comes close. For example, when the access of a human body to the antenna disposed in the lower portion is sensed, the processor may control the electronic device in such a manner that a signal is transmitted through an antenna disposed in the upper portion of the electronic device without being transmitted from the antenna disposed in the lower portion of the electronic device.

According to various embodiments, the sensor may include an electrocardiography sensor (e.g., the lower bezel section 414) in order to check the heart rate of a human body.

According to various embodiments, the sensor may include a temperature sensor (e.g., the lower bezel section 414) in which the lower bezel section 414 serves as a probe.

According to various embodiments, the sensor may include an underwater recognition sensor (a waterlogging recognition sensor) (e.g., the lower bezel section 414) configured to sense the dielectric constant of a liquid to recognize whether the electronic device is under water.

According to various embodiments, when the lower bezel section 414, the right bezel section 411, and the left bezel section 412 are directly and electrically connected to each other, the sensor 480 may be subjected to an increase of a fixed capacitance of the circuit from C1 to C1+C2+C3. In addition, the parasitic capacitance of each bezel section may also be added. When the total fixed capacitance value is out of an operation capacitance range of the sensor, the IC of the sensor 480 may be saturated not to sense a capacitance change there around, which may cause the grip sensor not to operate. In addition, although only the lower bezel section 414 may operate as a grip sensor, the right bezel section 411 and the left bezel section 412 may also operate as a grip sensor, thereby causing a malfunction.

According to various embodiments, in the case where an external ungrounded charging power source (e.g., an ungrounded travel adaptor (TA)) is used, the sensor may be designed such that a leakage current of a predetermined value or more is not sensed through a ground portion of the electronic device. However, when respective split portions are electrically connected to each other, the current amounts of the respective bezel sections are added up to be increased, which may cause an electric shock.

According to various embodiments, electric connection members 460 and 470 may be further provided between the lower bezel section 414 and the left bezel section 412 and between the lower bezel section 414 and the right bezel section 411 at split positions, respectively, in order to capacitively couple the respective bezel sections. According to one embodiment, the electric connection members 460 and 470 may be disposed to be spaced apart from, and coupled to, at least one of the bezel sections, rather than being directly and electrically contacted with at least one of the bezel sections. According to one embodiment, by the coupling connection structure of the electric connection members 460 and 470, the left bezel section 414 may operate as a short circuit with at least one of the left bezel section 412 and the right bezel section 411 for the transmission/reception of RF signals for an antenna radiator that operates in a high frequency band. According to one embodiment, by the coupling connection structure of the electric connection members 460 and 470, the left bezel section 414 may operate as an open circuit with at least one of the left bezel section 412 and the right bezel section 411 when operating in a low frequency band for the optimization of the grip sensor and the leakage current.

According to various embodiments, the above-described electric connection members 460 and 470 may include one or more of various members, such as a flexible printed circuit board (FPCB), a thin wire cable (e.g., a metal wire), a conductive gasket, and a thin metal plate. For example, when the FPCB is used, a bezel section may be directly fixed in such a way that a metal pattern is exposed from a region where the bezel section is electrically connected. In such a case, the FPCB may be fixed to the bezel section by soldering, using a conductive tape, welding, using a conductive clip, conductive bonding, or the like.

Figure 5A:
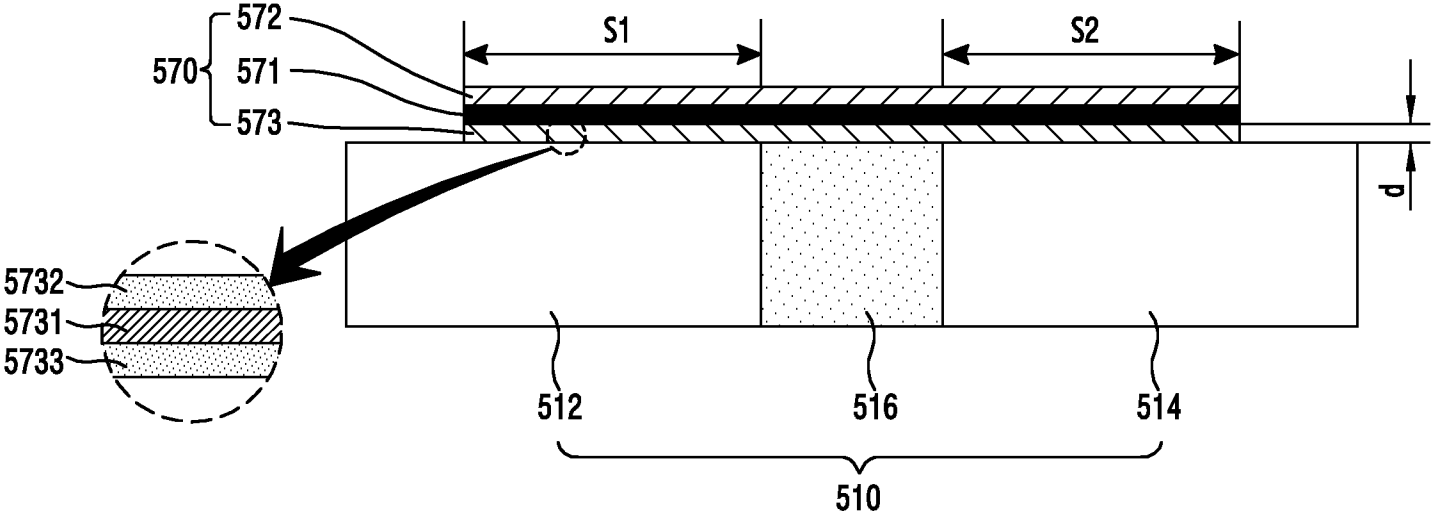
FIG. 5A illustrates a cross-sectional view of a main portion of a connection structure between two metal members according to various embodiments of the present disclosure.

FIG. 5A illustrates a cross-sectional view of a main portion of a connection structure between two metal members 512 and 514 according to various embodiments of the present disclosure.

According to various embodiments, the metal bezel 510 of FIG. 5 is an embodiment of a metal bezel that is similar to, or different from, the metal bezels 414, 412, and 411 of FIG. 4.

According to various embodiments, the metal bezel 510 may include a first metal member 512 and a second metal member 514 formed integrally with the first metal member 512 through a split portion 516.

According to various embodiments, the first metal member 512 and the second metal member 514, which are spaced apart from each other, may be capacitively connected to each other by the split portion 516. For example, the first metal member 512 and the second metal member 514 may be capacitively connected by an electric connection member (e.g., FPCB) 570. According to one embodiment, the first metal member 512 and the electric connection member 570, and the second metal member 514 and the electric connection member 570 may be connected to each other in a coupling manner.

According to various embodiments, the first metal member 512 may be a metal member, which is similar to, or different from, the lower bezel section 414 that is used as the antenna radiator and the sensor member of FIG. 4. The second metal member 514 may be a metal member, which is similar to, or different from, the right bezel section 411 or the left bezel section 412 that is capacitively connected to the lower bezel section 414 of FIG. 4 through a coupling.

According to various embodiments, an FPCB including a metal layer 571 may be used as the electric connection member 570. The electric connection member 570 may be disposed in such a manner in which one end is stacked on the top of the first member 512, and the other end is stacked on the top of the second metal member 514. According to one embodiment, the electric connection member 570 may be disposed in such a manner in which the metal layer 571 is interposed between an insulating film 572 and an insulating double-sided tape 573. According to one embodiment, the electric connection member 570 may be attached to one side face (e.g., the top face) of each of the first metal member 512, the split portion 516, and the second metal member 514 by the insulating double-sided tape 573.

According to various embodiments, the insulating double-sided tape 573 may include a poly ethylene terephthalate (PET) film layer 5731 and acrylic layers 5732 and 5733 laminated on the top and bottom of the PET film layer 5731 to be spaced apart from each other as adhesive layers.

According to various embodiments, the metal layer 571 of the electric connection member 570 may be disposed at a position where the metal layer 571 is not directly and electrically connected with the first metal member 512 and the second metal member 514 by the insulating double-sided tape 573, and is capable of being mutually coupled with at least one of the first metal member 512 and the second metal member 514. According to one embodiment, the first metal member 512 may be disposed to have an overlapping area S1 with the metal layer 571 of the electric connection member 570. The second metal member 514 may be disposed to have an overlapping area S2 with the metal layer 571 of the electric connection member 570. The metal layer 571 of the electric connection member 570 may be spaced apart from the first metal member 512 and the second metal member 514 by a spacing distance d. According to one embodiment, the capacitance generated between the electric connection member 570 and the first and second metal members 512 and 514 may be changed by changing at least one of the distance d between the metal layer 571 of the electric connection member 570 and the two metal members 512 and 514, the overlapping areas S1 and S2 between the metal layer 571 of the electric connection member 570 and the two metal members 512 and 514, and the material of the insulating double-sided tape 573. According to one embodiment, the distances d between the two metal members 512 and 514 and the metal layer 571 are illustrated as being equal to each other, but are not limited thereto. For example, the distance between one metal member 512 and the metal layer 571 and the distance the remaining one metal member 514 and the metal layer 571 may be different from each other.

Figure 5B:
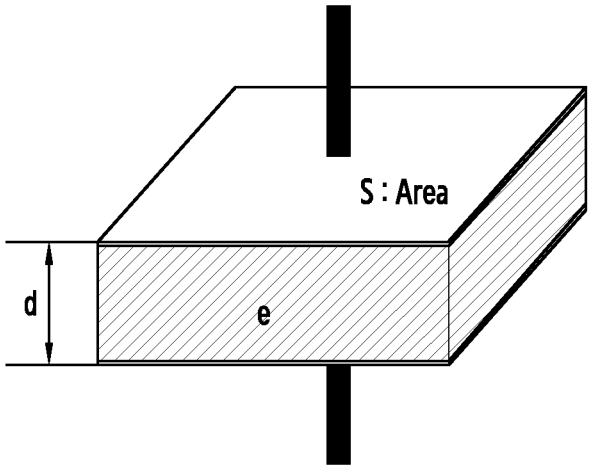
FIG. 5B illustrates a schematic view for calculating a capacitance for a dielectric between two metal plates according to various embodiments of the present disclosure.

FIG. 5B illustrates a schematic view for calculating a capacitance for a dielectric between two metal plates according to various embodiments of the present disclosure. FIG. 5B is a view for calculating capacitance between two metal objects through a coupling connection.

Referring to FIG. 5B, the area S of two metal plates (e.g., a metal layer and a metal member) may be calculated from Equation 1 as given below by using a dielectric constant of a dielectric (e.g., air or an insulating double-sided tape) between the two metal plates and a capacitance C.

$$C = \varepsilon \frac{S}{d} \quad \text{(Equation 1)}$$

wherein, C is a capacitance between two metal plate, S is an area of the metal plates, d is a spacing distance between the metal plates, and ε is εr×ε0 (εr is a specific dielectric constant and ε0=8.

$854\times10^{-12}$). That is, a desired capacitance C may be calculated in consideration of a relationship in which the capacitance C is in inverse proportion to the spacing distance d of the two metal plate, and is in proportion to the area S of the plates. Accordingly, the capacitance C may be changed by changing the overlapping areas (e.g., S1 and S2) between two metal plates, the spacing distance (e.g., d), or the dielectric constant of the dielectric.

Figure 6A:
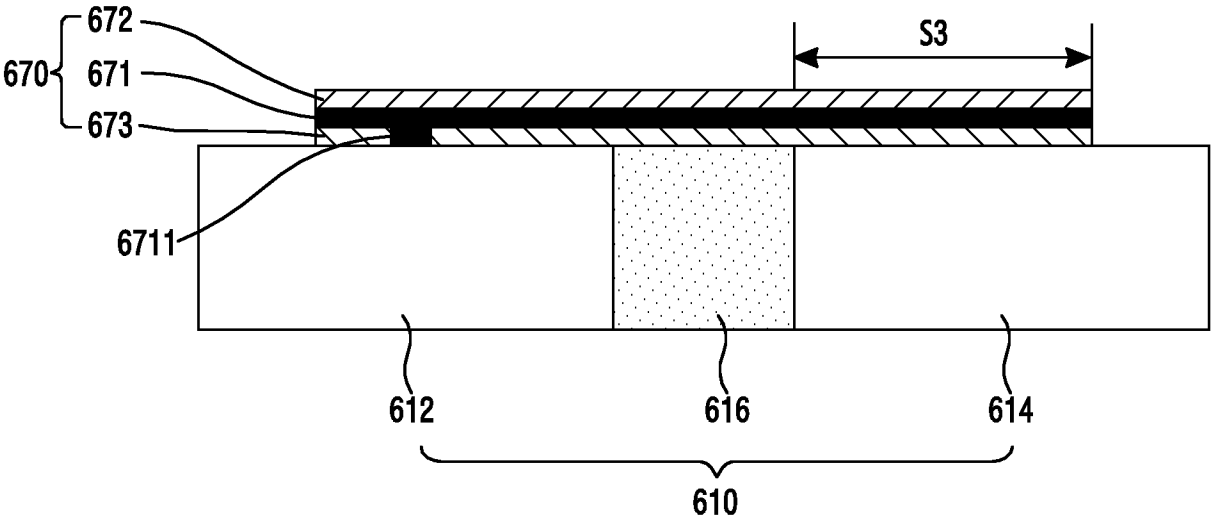
FIGS. 6A and 6B illustrate cross-sectional views of a main portion in a connection structure between two metal members according to various embodiments of the present disclosure.
Figure 6B:
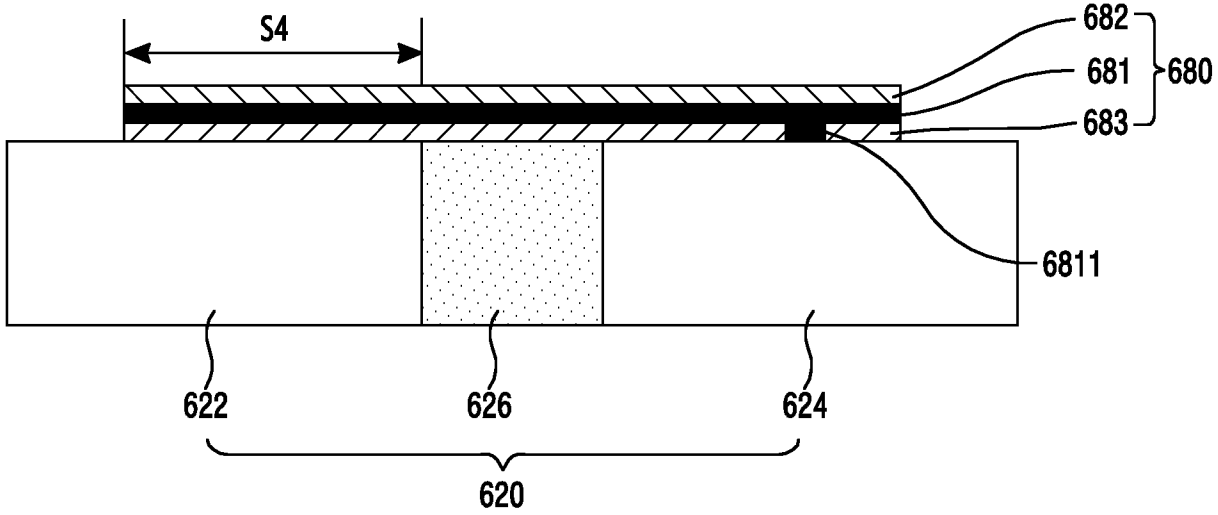

FIGS. 6A and 6B illustrate views of a main portion in a connection structure between two metal members 612 and 614 according to various embodiments of the present disclosure.

Referring to FIG. 6A, the metal members 612 and 614 are an embodiment of a metal bezel that is similar to, or different from, the metal bezels 414, 412, and 411 of FIG. 4.

According to various embodiments, the metal bezel 610 may include a first metal member 612 and a second metal member 614 formed integrally with the first metal member 612 through a split portion 616.

According to various embodiments, the first metal member 612 and the second metal member 614, which are spaced apart from each other, may be capacitively connected to each other by the split portion 616. For example, the first metal member 612 and the second metal member 614 may be capacitively connected by an electric connection member (e.g., FPCB) 670.

According to various embodiments, the first metal member 612 may be a metal member, which is similar to, or different from, the lower bezel section 414 that is used as the antenna radiator and the sensor member of FIG. 4. The second metal member 614 may be a metal member, which is similar to, or different from, the right bezel section 411 or the left bezel section 412 that is capacitively connected to the lower bezel section 414 of FIG. 4 through a coupling.

According to various embodiments, an FPCB including a metal layer 671 may be used as the electric connection member 670. The electric connection member 670 may be disposed in such a manner in which one end is stacked on the top of the first member 612, and the other end is stacked on the top of the second metal member 614. According to one embodiment, the electric connection member 670 may be disposed in such a manner in which the metal layer 671 is interposed between an insulating film 672 and an insulating double-sided tape 673. According to one embodiment, the electric connection member 670 may be attached to one side face (e.g., the top face) of each of the first metal member 612, the split portion 616, and the second metal member 614 by the insulating double-sided tape 673.

According to various embodiments, a partially exposed region 6711 of the metal layer 671 may pass through the insulating double-sided tape 673 to be directly and electrically contacted with the first metal member 612. According to one embodiment, the exposed region 6711 may be electrically connected to the first metal member 612 by soldering, by using a conductive tape, welding, using a conductive clip, conductive bonding, or the like. According to one embodiment, the metal layer 671 of the electric connection member 670 may be disposed at a position where the metal layer 671 is not directly and electrically connected with the second metal member 614 by the insulating double-sided tape 673, and is capable of being mutually coupled with the second metal member 614 to have a coupling area S3. Accordingly, the first metal member 612 and the second metal member 614 may be capacitively connected by an electric connection member 670 without being directly and electrically contacted with each other to be capable of being coupled. According to one embodiment, the capacitance may be determined based on the material or thickness of the insulating double-sided tape 673 disposed between the second metal member 614 and the metal layer 671.

According to various embodiments, the insulating double-sided tape 673 may be similar to, or different from, the insulating double-sided tape 573 of FIG. 5A.

Referring to FIG. 6B, the metal members 622 and 624 are an embodiment of a metal bezel that is similar to, or different from, the metal bezels 414, 412, and 411 of FIG. 4.

According to various embodiments, the metal bezel 620 may include a first metal member 622 and a second metal member 624 formed integrally with the first metal member 612 through a split portion 626.

According to various embodiments, the first metal member 622 and the second metal member 624, which are spaced apart from each other, may be capacitively connected to each other by the split portion 626. For example, the first metal member 622 and the second metal member 624 may be capacitively connected by an electric connection member (e.g., FPCB) 670.

According to various embodiments, the first metal member 622 may be a metal member, which is similar to, or different from, the lower bezel section 414 that is used as the antenna radiator and the sensor member of FIG. 4. The second metal member 624 may be a metal member, which is similar to, or different from, the right bezel section 411 or the left bezel section 412 that is capacitively connected to the lower bezel section 414 of FIG. 4 through a coupling.

According to various embodiments, an FPCB including a metal layer 681 may be used as the electric connection member 680. The electric connection member 680 may be disposed in such a manner in which one end is stacked on the top of the first member 622, and the other end is stacked on the top of the second metal member 624. According to one embodiment, the electric connection member 680 may be disposed in such a manner in which the metal layer 681 is interposed between an insulating film 682 and an insulating double-sided tape 683. According to one embodiment, the electric connection member 680 may be attached to one side face (e.g., the top face) of each of the first metal member 622, the split portion 626, and the second metal member 624 by the insulating double-sided tape 683.

According to various embodiments, a partially exposed region 6811 of the metal layer 681 may pass through the insulating double-sided tape 683 to be directly and electrically contacted with the second metal member 624. According to one embodiment, the exposed region 6811 may be electrically connected to the second metal member 624 by soldering by using a conductive tape, welding, using a conductive clip, conductive bonding, or the like. According to one embodiment, the metal layer 681 of the electric connection member 680 may be disposed at a position where the metal layer 681 is not directly and electrically connected with the first metal member 622 by the insulating double-sided tape 683, and is capable of being mutually coupled with the first metal member 622 to have a coupling area S4. Accordingly, the first metal member 622 and the second metal member 624 may be capacitively connected by an electric connection member 680 without being directly and electrically contacted with each other to be capable of being coupled. According to one embodiment, the capacitance may be determined based on the material or thickness of the insulating double-sided tape 683 disposed between the first metal member 622 and the metal layer 681.

According to various embodiments, at least a portion of the metal layer of the electric connection member is disposed to be spaced apart from the first metal member or the second metal member to have a predetermined coupling area, as described above. Thus, the first metal member is capacitively connected with the second metal member (short circuited) when operating as an antenna radiator of a high frequency band so that the radiation performance can be improved. According to one embodiment, the first metal member is not electrically connected with the second metal member (opened) when the first metal member is used as a grip sensor (or a member for optimizing a leakage current), thereby preventing a malfunction for a corresponding function.

According to various embodiments, the insulating double-sided tape 683 may be similar to, or different from, the insulating double-sided tape 573 of FIG. 5A.

Figure 7:
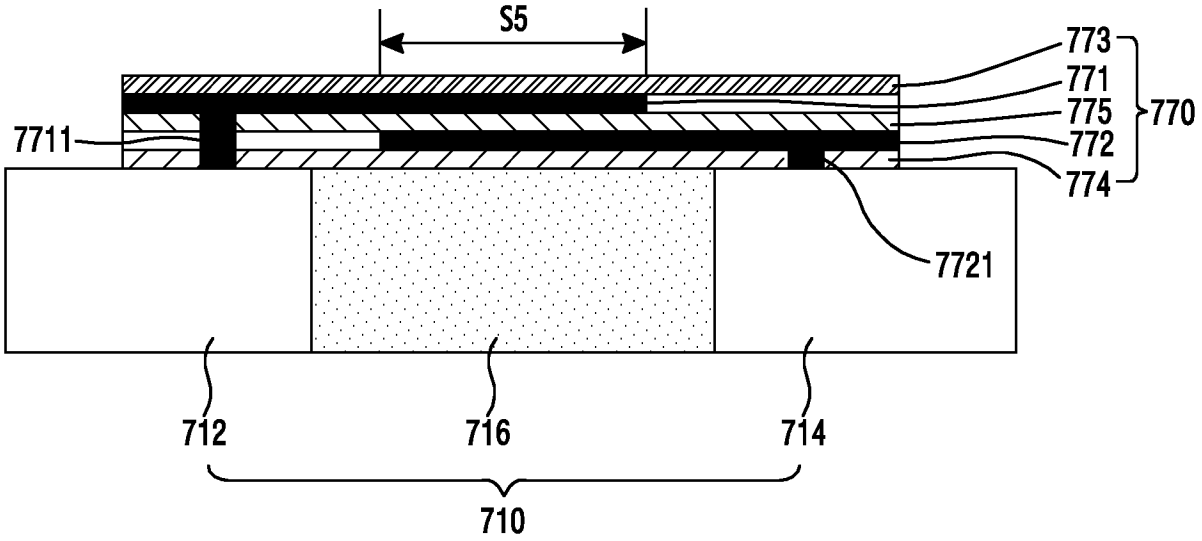
FIG. 7 illustrates a cross-sectional view of a main portion in a connection structure between two metal members according to various embodiments of the present disclosure.

FIG. 7 illustrates a cross-sectional view of a main portion in a connection structure between two metal members according to various embodiments of the present disclosure.

Referring to FIG. 7, the metal members 712 and 714 are an embodiment of a metal bezel that is similar to, or different from, the metal bezels 414, 412, and 411 of FIG. 4.

According to various embodiments, the metal bezel 710 may include a first metal member 712 and a second metal member 714 formed integrally with the first metal member 612 through a split portion 716.

According to various embodiments, the first metal member 712 and the second metal member 714, which are spaced apart from each other, may be capacitively connected to each other by the split portion 716. For example, the first metal member 712 and the second metal member 714 may be capacitively connected by an electric connection member (e.g., FPCB) 770.

According to various embodiments, the first metal member 712 may be a metal member, which is similar to, or different from, the lower bezel section 414 that is used as the antenna radiator and the sensor member of FIG. 4. The second metal member 714 may be a metal member, which is similar to, or different from, the right bezel section 411 or the left bezel section 412 that is capacitively connected to the lower bezel section 414 of FIG. 4 through a coupling. However, without being limited thereto, the second metal member 714 may be a metal member, which is similar to, or different from, the lower bezel section 414 that is used as the antenna radiator and the sensor member of FIG. 4. The first metal member 712 may be a metal member, which is similar to, or different from, the right bezel section 411 or the left bezel section 412 that is capacitively connected to the lower bezel section 414 of FIG. 4 through a coupling.

According to various embodiments, the electric connection member 770 may include an FPCB including two metal layers 771 and 772, which are spaced apart from each other. According to one embodiment, the electric connection member 770 may be disposed in such a manner in which one end is stacked on the top of the first member 712, and the other end is stacked on the top of the second metal member 714. According to one embodiment, the electric connection member 770 may be disposed in such a manner in which the pair of metal layers 771 and 772 are interposed between an insulating film 773 and an insulating double-sided tape 774 to be electrically separated from each other by an insulating layer 775. According to one embodiment, the electric connection member 770 may be attached to the top face of each of the first metal member 712, the split portion 716, and the second metal member 714 by the insulating double-sided tape 774.

According to various embodiments, a partially exposed region 7711 of the first metal layer 771 may pass through the insulating double-sided tape 774 and the insulating layer 775 to be directly and electrically contacted with the first metal member 712. According to one embodiment, the exposed region 7711 of the first metal layer 771 may be electrically connected to the first metal member 712 by soldering, by using a conductive tape, welding, using a conductive clip, conductive bonding, or the like. According to one embodiment, a partially exposed region 7721 of the second metal layer 772 may pass through the insulating double-sided tape 774 to be directly and electrically contacted with the second metal member 714. According to one embodiment, the exposed region 7721 may be electrically connected to the second metal member 714 by soldering, by using a conductive tape, welding, using a conductive clip, conductive bonding, or the like.

According to one embodiment, the electric connection member 770 may be disposed at a position where the electric connection member 770 does not cause the first metal member 712 and the second metal member 714 to be directly and electrically connected with each other, and is capable of mutually coupling the first metal member 712 and the second metal member 714 to have a coupling area S5 that is larger than the above-mentioned coupling area. Accordingly, the first metal layer and the second metal layer may be disposed on the top of the split portion to have an overlapping coupling area S5. According to one embodiment, the capacitance may be determined based on the material or thickness of the insulating layer 775 disposed between the first metal layer 771 and the second metal layer 772.

According to various embodiments, the insulating double-sided tape 774 may be similar to, or different from, the insulating double-sided tape 573 of FIG. 5A.

Figure 8:
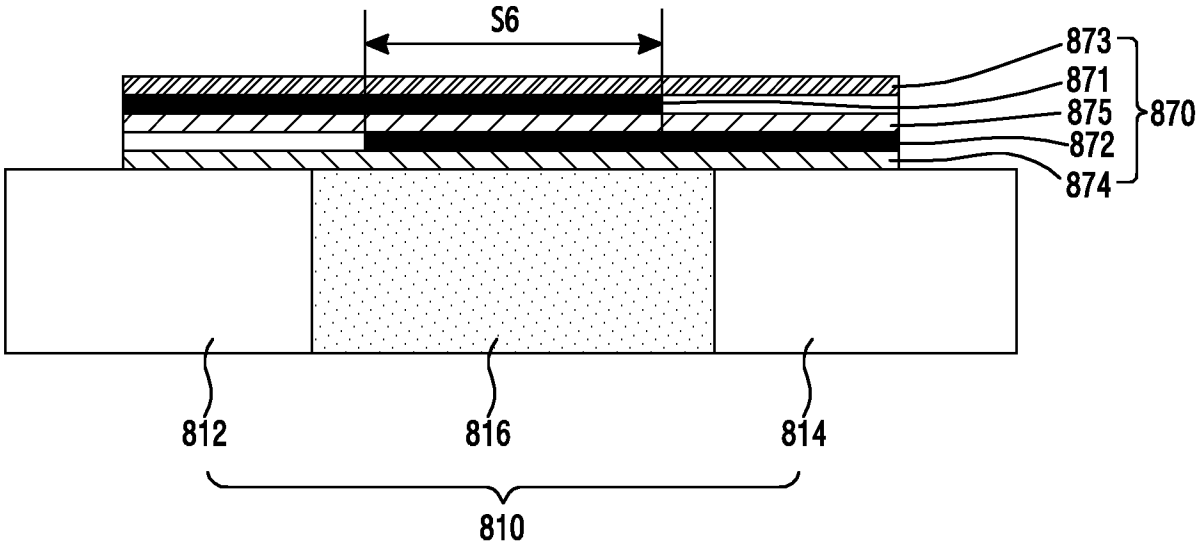
FIG. 8 illustrates a cross-sectional view of a main portion in a connection structure between two metal members according to various embodiments of the present disclosure.

FIG. 8 illustrates a cross-sectional view of a main portion in a connection structure between two metal members according to various embodiments of the present disclosure.

Referring to FIG. 8, the metal members 812 and 814 are an embodiment of a metal bezel that is similar to, or different from, the metal bezels 414, 412, and 411 of FIG. 4.

According to various embodiments, the metal bezel 810 may include a first metal member 812 and a second metal member 814 formed integrally with the first metal member 812 through a split portion 816.

According to various embodiments, the first metal member 812 and the second metal member 814, which are spaced apart from each other, may be capacitively connected to each other by the split portion 816. According to one embodiment, the first metal member 812 and the second metal member 814 may be capacitively connected by an electric connection member (e.g., an FPCB) 870.

According to various embodiments, the first metal member 812 may be a metal member, which is similar to, or different from, the lower bezel section 414 that is used as the antenna radiator and the sensor member of FIG. 4. The second metal member 814 may be a metal member, which is similar to, or different from, the right bezel section 411 or the left bezel section 412 that is capacitively connected to the lower bezel section 414 of FIG. 4 through a coupling. However, without being limited thereto, the second metal member 814 may be a metal member, which is similar to, or different from, the lower bezel section 414 that is used as the antenna radiator and the sensor member of FIG. 4. The first metal member 812 may be a metal member, which is similar to, or different from, the right bezel section 411 or the left bezel section 412 that is capacitively connected to the lower bezel section 414 of FIG. 4 through a coupling.

According to various embodiments, the electric connection member 870 may include an FPCB including two metal layers 871 and 872, which are spaced apart from each other. According to one embodiment, the electric connection member 870 may be disposed in such a manner in which one end is stacked on the top of the first member 812, and the other end is stacked on the top of the second metal member 814. According to one embodiment, the electric connection member 870 may be disposed in such a manner in which the pair of metal layers 871 and 872 are interposed between an insulating film 873 and an insulating double-sided tape 874 to be electrically separated from each other by an insulating layer 875. According to one embodiment, the electric connection member 870 may be attached to one side face (e.g., the top face) of each of the first metal member 812, the split portion 816, and the second metal member 814 by the insulating double-sided tape 874.

According to various embodiments, the first metal layer 871 may be disposed to be electrically separated from, but capacitively coupled to, the first metal member 812 by the insulating layer 875 and the insulating double-sided tape 874. According to one embodiment, the second metal layer 872 may be disposed to be electrically separated from, but capacitively coupled to, the second metal member 814 by the insulating double-sided tape 874. Accordingly, two metal layers 871 and 872 of the electric connection member 870 are configured to be electrically separated from, but capacitively connected, through a coupling, to the first metal member 812 and the second metal member 814. Thus, the region of the first metal layer 871 and the second metal layer 872, which are disposed to overlap with each other above the split portion 816, may contribute to an expanded coupling area S6. According to one embodiment, the capacitance may be determined based on the distance between dielectrics (e.g., the insulating layer 875, an insulating tape 874, or a space between the insulating layer 875 and the insulating tape 874) disposed between the first metal layer 871 and the first metal member 812, the thickness of the dielectrics, or the materials of the dielectrics. According to one embodiment, the capacitance may be determined based on the distance between dielectrics (e.g., insulating tapes 874) disposed between the first metal layer 872 and the second metal member 814, the thickness of the dielectrics, or the materials of the dielectrics.

According to various embodiments, the insulating double-sided tape 874 may be similar to, or different from, the insulating double-sided tape 573 of FIG. 5A.

According to various embodiments, it is possible to provide an electronic device that includes: a housing; a first conductive member that forms a portion of the housing and is at least partially disposed within the housing; a second conductive member that forms another portion of the housing and includes a portion disposed adjacent to a portion of the first conductive member; a non-conductive member disposed between the portion of the first conductive member and a portion of the second conductive member; a capacitive coupling structure connected between the first conductive member and the second conductive member; a communication circuit electrically connected to the first conductive member; and a sensor electrically connected to the first conductive member.

According to various embodiments, the communication circuit may be configured to change a signal applied to the first conductive member at least partially in response to a signal from the sensor.

According to various embodiments, the capacitive coupling structure may include: a first non-conductive member configured to be in contact with a portion of the first conductive member and a portion of the second conductive member, a second non-conductive structure disposed to be spaced apart from the first non-conductive structure; and a first conductive structure inserted between the first non-conductive structure and the second non-conductive structure and configured to come in contact with the first non-conductive structure and the second non-conductive structure, and to be insulated from the first conductive member and the second conductive member.

According to various embodiments, the capacitive coupling structure may include: a first non-conductive member configured to be in contact with a portion of the first conductive member and a portion of the second conductive member; a second non-conductive structure disposed to be spaced apart from the first non-conductive structure; and a first conductive structure inserted between the first non-conductive structure and the second non-conductive structure, and configured to come in contact with the first non-conductive structure and the second non-conductive structure, to be electrically connected to the first conductive member, and to be insulated from the second conductive member.

According to various embodiments, the capacitive coupling structure may include: a non-conductive member configured to be in contact with a portion of the first conductive member and a portion of the second conductive member; a second non-conductive structure disposed to be spaced apart from the first non-conductive structure; and a first conductive structure inserted between the first non-conductive structure and the second non-conductive structure, and configured to come in contact with the first non-conductive structure and the second non-conductive structure, to be insulated from the first conductive member, and to be electrically connected the second conductive member.

According to various embodiments, the capacitive coupling structure may include a third non-conductive structure and a second conductive structure inserted between the second non-conductive structure and the third non-conductive structure, and the second conductive structure may be configured to be insulated from the first and second conductive members or to be insulated from one of the first and second conductive members, and to be electrically connected to another one of the first and second conductive members.

According to various embodiments, the first non-conductive structure may include a first non-conductive film, and the first non-conductive film may include at least one first adhesive layer on a first face directed toward the first conductive member and/or the second conductive member.

According to various embodiments, the first non-conductive film may include at least one second adhesive layer on a second face directed opposite to the first conductive member and/or the second conductive member.

According to various embodiments, the first non-conductive structure may include at least one adhesive layer.

According to various embodiments, the first non-conductive structure may include a first non-conductive material, and the second non-conductive structure may include a second non-conductive material, which is different from the first non-conductive material.

According to various embodiments, the first non-conductive material may include an acrylic adhesive, and the second non-conductive material may include polyimide.

According to various embodiments, the housing may include a first face, a second face directed opposite to the first face, and a side face at least partially enclosing a space between the first face and the second face, the first conductive member may form a first portion of the side face, the second conductive member may form a second portion of the side face, which is adjacent to the first portion, and the first non-conductive member may include a third portion of the side face, which is disposed between the first portion and the second portion of the side face.

According to various embodiments, a space provided between the first portion and the second portion may be 0.1 mm to 3 mm.

According to various embodiments, the housing may include a first side and a second side that extends from the first side perpendicularly and is longer than the first side, the first conductive member may form a portion of the first side, and the second conductive member may form another portion of the first side.

According to various embodiments, the second conductive member may further form a portion of the second side.

According to various embodiments, it is possible to provide an electronic device including: a first metal member configured to both of a first function that operates in a first frequency band and a second function that operates in a second frequency band; at least one second metal member configured to be coupled with the first metal member in a manner of being insulated by a split portion made of a dielectric material; and an electric connection member configured to capacitively interconnect the first metal member and the second metal member through a coupling.

According to various embodiments, the first metal member may operate in cooperation with the second metal member when the first function is performed, and the second function may be solely performed regardless of the second metal member.

According to various embodiments, the first function may include a transmission/reception function of a communication signal using the first metal member, and the second function may include a sensing function using the first metal member.

According to various embodiments, the first frequency band may be a band of a high frequency signal for transmission/reception of a signal of an RF band, and the second frequency band may include a low frequency band for the sensing function.

According to various embodiments, the sensing function may include at least one of a grip sensor function using the first metal member as a probe, a touch sensor function, an electrocardiography sensor function, a temperature sensor function, and an underwater detection sensor function.

According to various embodiments, the electric connection member may be spaced apart from at least one of the first metal member and the second metal member by a predetermined distance and may be capacitively connected thereto by a coupling operation.

According to various embodiments, any one of the first metal member and the second metal member may be directly and electrically connected to the electric connection member by an electric contact.

According to various embodiments, the capacitance of at least one of the first metal member and the second metal member may be changed by changing an overlapping area with the electric connection member, a spacing distance from the electric connection member, and a dielectric constant of a dielectric interposed therebetween.

According to various embodiments, the electric connection member may include: an insulating double-sided tape, of which one end is stacked on the first metal member and the other end is stacked on the top of the second metal member; at least one metal layer stacked on the top of the insulating double-sided tape; and an insulating film stacked on the top of the metal layer. The metal layer may be spaced apart from at least one of the first metal member and the second metal member by a predetermined distance and may be capacitively connected thereto by a coupling operation.

According to various embodiments, any one of the first metal member and the second metal member may be directly and electrically connected to the electric connection member by an electric contact.

According to various embodiments, the metal layer may include a first metal layer that is electrically contacted with the first metal member, and a second metal layer that is spaced apart from the first metal layer by an insulating layer and is electrically contacted with the second metal member.

According to various embodiments, the first metal layer and the second metal layer may be disposed to have a coupling region in which the first metal layer and the second metal layer overlap with each other in a vertical direction.

According to various embodiments, the coupling region may be disposed in a region that vertically overlaps with the split portion.

According to various embodiments, the metal layer may include a first metal layer that is spaced apart from the first metal member and capacitively connected thereto in a coupling manner and a second metal layer that is spaced apart from the first metal layer by an insulating layer and is capacitively connected with the second metal member in a coupling manner.

According to various embodiments, the first metal layer and the second metal layer may be disposed to have a coupling region in which the first metal layer and the second metal layer overlap with each other in a vertical direction.

According to various embodiments, the electric connection members may include one or more of an FPCB, a thin wire cable (e.g., a metal wire), a conductive gasket, and a thin metal plate.

According to various embodiments, the first metal member and the second metal member may be a metal bezel that is disposed in at least partial region of the exterior of the electronic device.

According to various embodiments, the metal bezel may include a first metal bezel disposed as a portion of the exterior of the electronic device and performs both of a first function and a second function, a second metal bezel disposed to be electrically spaced apart from the first metal bezel by a split portion, and an electric connection member configured to capacitively interconnect the first metal member and the second metal member through a coupling. According to various embodiments, the electric connection member may include: an insulating double-sided tape stacked on the top of the first metal bezel and the second metal bezel; at least one metal layer stacked on the top of the insulating double-sided tape; and an insulating film stacked on the top of the metal layer. The metal layer may be spaced apart from at least one of the first metal member and the second metal member by a predetermined distance and may be capacitively connected thereto by a coupling operation.

According to various embodiments, the first function may include a transmission/reception function of a communication signal using the first metal bezel, and the second function may include a sensing function using the first metal bezel.

According to various embodiments, the metal layer may include a first metal layer electrically contacted with any one of the first metal bezel and the second metal bezel, and a second metal layer spaced apart from the first metal layer by an insulating layer and electrically contacted with the remaining one metal bezel.

Figure 9:
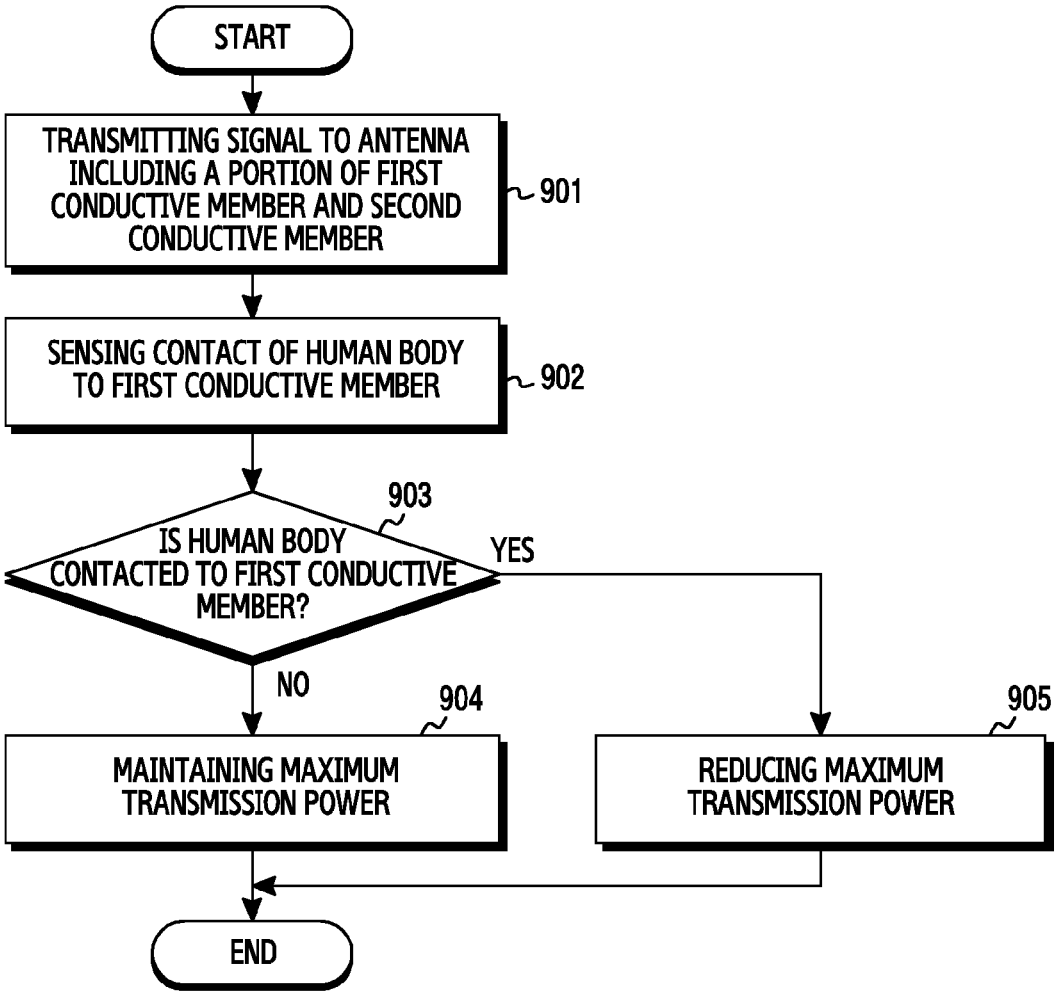
FIG. 9 illustrates a flowchart of an operation relationship between two metal members capacitively connected through a coupling connection according to various embodiments of the present disclosure.

FIG. 9 illustrates a flowchart of an operation relationship between two metal members capacitively connected through a coupling connection according to various embodiments of the present disclosure.

Referring to FIG. 9, in operation 901, an operation of transmitting a signal to an antenna that partially includes the first conductive member and the second conductive member may be performed. According to one embodiment, in the case of an electronic device, the two conductive members may be metal bezels that are disposed to be spaced apart from each other by a split portion in at least a partial region of the exterior of the electronic device. According to one embodiment, the split portion may be formed of an insulating material. According to one embodiment, an electric connection member may be provided in order to capacitively connecting the first and second conductive members, which are electrically spaced apart from each other by the split portion. According to one embodiment, the electric connection member may connect the first and second conductive members to be capable of being coupled to each other such that the first and second conductive members are electrically separated from each other, but are capacitively connected to each other.

According to various embodiments, the first conductive member may perform two functions. According to one embodiment, the first conductive member may be used for a first function (e.g., a transmission/reception function of a signal by an antenna radiator). According to one embodiment, the first conductive member may perform a second function (e.g., a grip sensing function, an electrocardiography sensing function, an ordinary touch sensing function, a temperature sensing function, or an underwater recognition sensing function).

In operation 902, an operation of sensing a contact of a human body to the first conductive member may be performed. In a case where a contact of a human body to the first conductive member is not sensed in operation 903, the maximum transmission power can be maintained in operation 904. According to one embodiment, in operation 904, the first conductive member may perform the first function in cooperation with the second conductive member. According to one embodiment, when a frequency related to the first function is applied, the impedance of the coupling structure is lowered such that the antenna may operate like a short circuit in which a first function signal is transferred to the second conductive member.

In operation 903, when a contact of a human body to the first conductive member is sensed, the process may proceed to operation 905 to perform an operation of lowering the maximum transmission power. In operation 905, the first conductive member may solely perform the second function regardless of (without being influenced by) the second conductive member. According to one embodiment, when a frequency of the second function is applied, the impedance of the coupling structure is increased such that the antenna may operate like an open circuit in which the second function signal is not transferred to the second conductive member.

According to various embodiments, through a capacitive connection by the coupling between two metal members, it is possible to improve the radiation performance of the antenna, and to contribute to the improvement of a sensing function and the optimization design of a leakage current.

According to various embodiments, it is possible to provide an electronic device that includes: a first metal member configured to both of a first function that operates in a first frequency band and a second function that operates in a second frequency band; at least one second metal member configured to be coupled with the first metal member in a manner of being insulated by a split portion made of a dielectric material; and an electric connection member configured to capacitively interconnect the first metal member and the second metal member through a coupling.

According to various embodiments, when the first function is performed, the first metal member may operate in cooperation with the second metal member, and the second function may be solely performed regardless of the second metal member.

According to various embodiments, the first function may include a communication signal transmission/reception function using the first metal member, and the second function may include a sensing function using the first metal member.

According to various embodiments, the first frequency band is a band of a high frequency signal for the transmission/reception of an RF band signal, and the second frequency band may include a low frequency band for the sensing function.

According to various embodiments, the sensing function may include at least one of a grip sensor function using the first metal member as a probe, a touch sensor function, an electrocardiography sensor function, a temperature sensor function, and an underwater detection sensor function.

According to various embodiments, the electric connection member may be spaced apart from at least one of the first metal member and the second metal member by a predetermined distance and may be capacitively connected thereto by a coupling operation.

According to various embodiments, any one of the first metal member and the second metal member may be directly and electrically connected to the electric connection member by an electric contact.

According to various embodiments, the capacitance of at least one of the first metal member and the second metal member may be changed by changing an overlapping area with the electric connection member, a spacing distance from the electric connection member, and a dielectric constant of a dielectric interposed therebetween.

According to various embodiments, the electric connection member may include: an insulating double-sided tape, of which one end is stacked on the first metal member and the other end is stacked on the top of the second metal member; at least one metal layer stacked on the top of the insulating double-sided tape; and an insulating film stacked on the top of the metal layer. The metal layer may be spaced apart from at least one of the first metal member and the second metal member by a predetermined distance and may be capacitively connected thereto by a coupling operation.

According to various embodiments, any one of the first metal member and the second metal member may be directly and electrically connected to the electric connection member by an electric contact.

According to various embodiments, the metal layer may include a first metal layer that is electrically contacted with the first metal member, and a second metal layer that is spaced apart from the first metal layer by an insulating layer and is electrically contacted with the second metal member.

According to various embodiments, the first metal layer and the second metal layer may be disposed to have a coupling region in which the first metal layer and the second metal layer overlap with each other in a vertical direction.

According to various embodiments, the coupling region may be disposed in a region that vertically overlaps with the split portion.

According to various embodiments, the metal layer may include a first metal layer that is spaced apart from the first metal member and capacitively connected thereto in a coupling manner and a second metal layer that is spaced apart from the first metal layer by the insulating layer, and spaced apart from the second metal member at a predetermined interval and capacitively connected thereto in a coupling manner.

According to various embodiments, the first metal layer and the second metal layer may be disposed to have a coupling region in which the first metal layer and the second metal layer overlap with each other in a vertical direction.

According to various embodiments, the electric connection members may include one or more of an FPCB, a thin wire cable (e.g., a metal wire), a conductive gasket, and a thin metal plate.

According to various embodiments, the first metal member and the second metal member may include a metal bezel that is disposed in at least a partial region of the exterior of the electronic device.

According to various embodiments, it is possible to provide an electronic device that includes: a first metal bezel disposed as a portion of the exterior of the electronic device and configured to perform both of a first function and a second function; a second metal bezel disposed to be electrically spaced apart from the first metal bezel by a split portion; and an electric connection member configured to capacitively interconnect the first metal member and the second metal member through a coupling. The electric connection member may include: an insulating double-sided tape stacked on the top of the first metal bezel and the second metal bezel; at least one metal layer stacked on the top of the insulating double-sided tape; and an insulating film stacked on the top of the metal layer. The metal layer may be spaced apart from at least one of the first metal bezel and the second metal bezel by a predetermined distance and may be capacitively connected thereto by a coupling operation.

According to various embodiments, the first function may include a communication signal transmission/reception function using the first metal member, and the second function may include a sensing function using the first metal bezel.

According to various embodiments, the metal layer may include a first metal layer electrically contacted with any one of the first metal bezel and the second metal bezel, and a second metal layer spaced apart from the first metal layer by an insulating layer and electrically contacted with the remaining one metal bezel.

The embodiments of the present disclosure disclosed in the specification and the drawings are only particular examples proposed in order to easily describe the technical matters of the present disclosure and help with comprehension of the present disclosure, and do not limit the scope of the present disclosure. Therefore, in addition to the embodiments disclosed herein, the scope of the various embodiments of the present disclosure should be construed to include all modifications or modified forms drawn based on the technical idea of the various embodiments of the present disclosure.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:

a housing;

a first conductive member that forms a portion of the housing or is at least partially disposed within the housing;

a second conductive member that forms another portion of the housing and includes a portion disposed adjacent to the first conductive member;

a non-conductive member disposed between the portion of the first conductive member and a portion of the second conductive member;

a capacitive coupling structure coupled between the first conductive member and the second conductive member;

a communication circuit electrically coupled to the first conductive member; and a sensor electrically coupled to the first conductive member.

2. The electronic device of claim 1, wherein the communication circuit is configured to change a signal applied to the first conductive member at least partially in response to a signal from the sensor.

3. The electronic device of claim 1, wherein the capacitive coupling structure includes:

the non-conductive member configured to be in contact with a portion of the first conductive member and a portion of the second conductive member;

a second non-conductive structure disposed to be spaced apart from a first non-conductive structure; and a first conductive structure inserted between the first non-conductive structure and the second non-conductive structure, configured to come in contact with the first non-conductive structure and the second non-conductive structure, and insulated from the first conductive member and the second conductive member.

4. The electronic device of claim 3, wherein the capacitive coupling structure includes:

a third non-conductive structure; and a second conductive structure inserted between the second non-conductive structure and a third non-conductive structure, and the second conductive structure is configured to be insulated from the first conductive member and the second conductive member or insulated from one of the first and second conductive members, and electrically coupled to another one of the first and second conductive members.

5. The electronic device of claim 3, wherein the first non-conductive structure includes a first non-conductive film, and wherein the first non-conductive film includes at least one first adhesive layer on a first face directed toward at least one of the first conductive member or the second conductive member.

6. The electronic device of claim 5, wherein the first non-conductive film includes at least one second adhesive layer on a second face directed opposite to at least one of the first conductive member or the second conductive member.

7. The electronic device of claim 3, wherein the first non-conductive structure includes at least one adhesive layer.

8. The electronic device of claim 3, wherein the first non-conductive structure includes a first non-conductive material, and wherein the second non-conductive structure includes a second non-conductive material that is different than the first non-conductive material.

9. The electronic device of claim 8, wherein the first non-conductive material includes an acrylic adhesive, and wherein the second non-conductive material includes polyimide.

10. The electronic device of claim 1, wherein the capacitive coupling structure includes:

the non-conductive member configured to be in contact with a portion of the first conductive member and a portion of the second conductive member;

a second non-conductive structure disposed to be spaced apart from a first non-conductive structure; and a first conductive structure inserted between the first non-conductive structure and the second non-conductive structure, configured to come in contact with the first non-conductive structure and the second non-conductive structure, electrically coupled to the first conductive member, and insulated from the second conductive member.

11. The electronic device of claim 1, wherein the capacitive coupling structure includes:

the non-conductive member configured to be in contact with a portion of the first conductive member and a portion of the second conductive member;

a second non-conductive structure disposed to be spaced apart from a first non-conductive structure; and a first conductive structure inserted between the first non-conductive structure and the second non-conductive structure, configured to come in contact with the first non-conductive structure and the second non-conductive structure, insulated from the first conductive member, and electrically coupled to the second conductive member.

12. The electronic device of claim 1, wherein the housing includes a first face, a second face directed opposite to the first face, a side face at least partially enclosing a space between the first face and the second face, the first conductive member forming a first portion of the side face, the second conductive member forming a second portion of the side face that is adjacent to the first portion of the side face, and the non-conductive member including a third portion of the side face that is disposed between the first portion and the second portion of the side face.

13. The electronic device of claim 12, wherein a space provided between the first portion and the second portion of the side face is 0.1 mm to 3 mm.

14. The electronic device of claim 12, wherein the capacitive coupling structure extends from the first portion of the side face to the second portion of the side face through the third portion of the side face.

15. The electronic device of claim 14, wherein the capacitive coupling structure is disposed to be in contact with the first portion, the second portion, and the third portion of the side face.

16. The electronic device of claim 1, wherein the sensor includes at least one of a grip sensor or a touch sensor.

17. The electronic device of claim 1, wherein the communication circuit is configured to transmit and receive a signal including a frequency in a range of 600 megahertz (MHz) to 6 gigahertz (GHz) through the first conductive member.

18. The electronic device of claim 1, wherein the housing includes a first side and a second side that extends from the first side perpendicularly and is longer than the first side, the first conductive member forming a portion of the first side, and the second conductive member forming another portion of the first side.

19. The electronic device of claim 18, wherein the second conductive member further forms a portion of the second side.

* * * * *